US011919684B2

(12) United States Patent
Zeiler

(10) Patent No.: US 11,919,684 B2
(45) **Date of Patent: *Mar. 5, 2024**

(54) TAMPER EVIDENT MEAL DELIVERY CARTON

(71) Applicant: Huhtamaki, Inc., De Soto, KS (US)

(72) Inventor: George Zeiler, Olathe, KS (US)

(73) Assignee: HUHTAMAKI, INC., De Soto, KS (US)

( * ) Notice: Subject to any disclaimer, the term of this patent is extended or adjusted under 35 U.S.C. 154(b) by 193 days.

This patent is subject to a terminal disclaimer.

(21) Appl. No.: 17/340,894

(22) Filed: Jun. 7, 2021

(65) Prior Publication Data

US 2021/0292040 A1 Sep. 23, 2021

Related U.S. Application Data

(63) Continuation-in-part of application No. 16/510,427, filed on Jul. 12, 2019, now Pat. No. 11,040,797.

(Continued)

(51) Int. Cl.

| | |
|---|---|
| ***B65D 5/20*** | (2006.01) |
| ***B65D 5/02*** | (2006.01) |
| ***B65D 5/10*** | (2006.01) |
| ***B65D 5/22*** | (2006.01) |
| ***B65D 5/26*** | (2006.01) |
| ***B65D 5/54*** | (2006.01) |

(Continued)

(52) U.S. Cl.

CPC ..... *B65D 5/106* (2013.01); *B65D 5/0254* (2013.01); *B65D 5/542* (2013.01); *B65D 5/6664* (2013.01); *B65D 17/04* (2013.01); *B65D 17/08* (2013.01); *B65D 2401/60* (2020.05); *Y10S 206/807* (2013.01)

(58) Field of Classification Search

CPC ..... B65D 5/106; B65D 5/0254; B65D 5/542; B65D 5/6664; B65D 5/667; B65D 17/04; B65D 17/08; B65D 2401/60; B65D 5/6655; B65D 5/6608; B65D 5/685; B65D 5/22; Y10S 229/902; Y10S 206/807; B31B 50/732; B31B 50/734

USPC ..... 220/266; 229/150, 125.28, 125.27, 229/125.26, 102, 149; 493/162

See application file for complete search history.

(56) References Cited

U.S. PATENT DOCUMENTS 117,349 A 7/1871 Tuttle
265,589 A * 10/1882 Fiske ..... B65D 5/6661 229/149

(Continued)

*Primary Examiner* — Gideon R Weinerth

(74) *Attorney, Agent, or Firm* — Husch Blackwell LLP

(57) ABSTRACT

A tamper evident feature for a container is provided. The tamper evident feature may include a locking tab connected to a wall panel or cover panel of the container and a receiving slot provided on the opposing cover panel or wall panel of the container. The locking tab may include an outer terminal edge and a slit extending laterally across the locking tab. The slit may provide a cut edge extending partially across an intermediate portion of the locking tab and allow for a tab end portion to bend relative to the remainder of the locking tab. The receiving slot may include a receiving slit defined into the cover panel of the container and configured to receive the locking tab. The receiving slit may provide a receiving edge that engages with the cut edge of the locking tab to secure the cover panel in a closed position.

16 Claims, 21 Drawing Sheets

Related U.S. Application Data

(60) Provisional application No. 63/165,848, filed on Mar. 25, 2021, provisional application No. 62/696,964, filed on Jul. 12, 2018.

(51) Int. Cl.
*B65D 5/66* (2006.01)
*B65D 17/00* (2006.01)

(56) References Cited

U.S. PATENT DOCUMENTS 1,081,981 A * 12/1913 Palmer ..... B65D 5/6661 229/84
1,103,976 A * 7/1914 Maier ..... B65D 5/68 229/125.21
1,108,464 A * 8/1914 Morey ..... B65D 5/0254 229/149
1,130,271 A 3/1915 Hammond
1,277,459 A * 9/1918 Myers ..... B65D 5/6661 229/148
1,470,141 A * 10/1923 Bryson ..... B65D 5/0263 229/152
1,476,822 A 12/1923 Kronenberger
1,681,700 A * 8/1928 Folmer ..... B65D 85/327 229/149
1,963,378 A 6/1934 Petter
1,984,371 A * 12/1934 Hazard ..... B65D 5/6667 229/148
2,125,042 A 7/1938 Bergstein
2,160,164 A * 5/1939 Palmer ..... B65D 5/26 229/160
2,210,707 A * 8/1940 Chally ..... B65D 5/248 229/152
2,316,362 A 4/1943 Poe
2,340,753 A 2/1944 Inman
2,361,124 A * 10/1944 Ringholz ..... B65D 5/6608 229/148
2,456,841 A 12/1948 Rushing
2,481,288 A 9/1949 Cage
2,511,523 A 6/1950 Abrams
2,572,159 A * 10/1951 Kells ..... B65D 5/6652 229/160
2,675,160 A * 4/1954 Buttery ..... B65D 5/6661 229/148
2,776,082 A * 1/1957 Bennorth ..... B65D 85/325 206/521.7
2,961,144 A 11/1960 Anderson, Jr.
2,999,626 A * 9/1961 Mcdermott ..... B65D 5/68 229/125.28
3,021,993 A 2/1962 Kennedy et al.
3,104,795 A * 9/1963 Adams ..... B65D 5/106 229/185
3,105,626 A 10/1963 Mccormick et al.
3,191,845 A 6/1965 Wainberg
3,201,026 A 8/1965 Travis et al.
3,357,630 A 12/1967 Michelitsch
3,462,066 A 8/1969 Farquhar
3,543,995 A 12/1970 Wilson
3,580,482 A * 5/1971 Witte ..... B65D 5/5435 229/925
3,827,624 A * 8/1974 Dogliotti ..... B65D 5/6655 229/149
4,063,678 A * 12/1977 Hall ..... B65D 5/106 229/222
4,077,513 A * 3/1978 Ferrara, Jr. ..... B65D 5/64 229/149
4,163,492 A 8/1979 Rella
4,339,068 A 7/1982 Brauner
4,516,718 A 5/1985 Forbes, Jr.
4,763,832 A * 8/1988 Forbes, Jr. ..... B65D 5/667 229/152
5,236,122 A 8/1993 Ballard
5,318,218 A 6/1994 Mattson
5,467,916 A 11/1995 Beales
5,522,538 A * 6/1996 Gray ..... B65D 5/2057 229/149
6,283,364 B1 9/2001 Gray, Sr.
D449,520 S * 10/2001 DiZoglio, III ..... B65D 5/2057 D9/423
6,296,175 B1 10/2001 Dixon
7,267,261 B2 9/2007 Lo Duca
7,980,452 B2 7/2011 Burton
8,408,451 B2 * 4/2013 Adam ..... B65D 5/6608 229/222
9,573,719 B2 * 2/2017 Deering ..... B65D 5/106
11,040,797 B2 * 6/2021 Zeiler ..... B65D 5/106
11,186,406 B2 * 11/2021 Chapman ..... B65D 5/667
D965,433 S * 10/2022 Wikstrom ..... B65D 5/6661 D9/449
11,465,798 B2 * 10/2022 Epstein ..... B65D 5/667
11,560,252 B2 * 1/2023 Zeiler ..... B65D 5/3642
2003/0222130 A1 * 12/2003 Fukushima ..... B65D 5/4291 229/149
2004/0031706 A1 * 2/2004 Stringfield ..... B65D 5/6602 229/131.1
2010/0032475 A1 2/2010 Burton
2011/0136641 A1 * 6/2011 Lee ..... B65D 5/6655 493/162
2014/0353367 A1 * 12/2014 Fairchild, Jr. ..... B65D 5/6608 229/149
2016/0214758 A1 * 7/2016 Yamamura ..... B65D 5/4266
2017/0313464 A1 * 11/2017 Mccarthy ..... B65D 5/6664
2019/0100346 A1 * 4/2019 Bressan ..... B65D 5/6608
2019/0300232 A1 10/2019 Chapman et al.
2019/0344927 A1 * 11/2019 Ozgercel ..... B65D 5/22
2020/0017254 A1 * 1/2020 Zeiler ..... B65D 17/08
2020/0031545 A1 1/2020 Bressan et al.
2020/0339303 A1 * 10/2020 Zeiler ..... B65D 5/3642
2020/0391903 A1 * 12/2020 Donschietz ..... B65D 5/5455
2021/0292040 A1 * 9/2021 Zeiler ..... B65D 5/542
2022/0017263 A1 * 1/2022 Wikstrom ..... B65D 85/36
2022/0055794 A1 * 2/2022 Humberstone ..... B65D 5/22
2023/0331430 A1 * 10/2023 Valance ..... B65D 5/2057

* cited by examiner

TAMPER EVIDENT MEAL DELIVERY CARTON

CROSS-REFERENCE TO RELATED APPLICATIONS

This Application is a continuation-in-part of and claims priority to U.S. patent application Ser. No. 16/510,427, filed on Jul. 12, 2019, to George Zeiler, entitled "Tamper Evident Meal Delivery Carton," currently pending, which claims priority to U.S. Provisional Patent Application No. 62/696,964, filed on Jul. 12, 2018, to George Zeiler, entitled "Tamper Evident Meal Delivery Carton." This Application also claims priority to U.S. Provisional Patent Application Ser. No. 63/165,848, filed on Mar. 25, 2021, to George Zeiler, entitled "Tamper Evident Meal Delivery Carton," currently pending. The entire disclosures, including the specifications and drawings, of all above-referenced applications are incorporated herein by reference.

BACKGROUND OF THE INVENTION

Paperboard containers are commonly used to store and hold food items, particularly when such food items are to be delivered, for example through a third party delivery service. Such containers are commonly folded carton structures having a perimeter sidewall and a closable cover. Restaurants and food service providers will place the food items ordered by a customer within the container, close the cover, and provide the container to a third party delivery person to deliver the container to the customer. One problem with these containers is that there are insufficient means for preventing tampering of the container or for providing evidence that the container has been opened or tampered with prior to the delivery of the food items. As the use of third party delivery services increases, food service providers are more concerned about ensuring that the food items are delivered as ordered; however, food delivery containers currently utilized do not restrict tampering with the food items prior to delivery to the customer. Accordingly, a need exists for a feature for providing evidence of tampering with a food container prior to the final delivery of food items contained therein.

BRIEF SUMMARY OF THE INVENTION

The present invention is directed to a tamper evident feature for a container that may be used to secure the container in a closed configuration and restrict access to the interior contents of the container without providing visible evidence that the container has been opened. The tamper evident feature may be used in connection with food delivery containers commonly utilized by restaurants, quick-service food providers and other food service providers; however, it is recognized that the tamper evident feature may be incorporated into any type of container, carton or other closable vessel for any suitable application.

According to one embodiment, the tamper evident feature may include a locking tab connected to and extending from a wall panel of a container and a receiving slot provided on a cover panel of the container. The locking panel may be configured to be at least partially inserted into the receiving slot and interlock with the receiving slot in order to secure the container in a closed position. As further described herein, according to an alternative embodiment, the locking tab may be connected to and extend from the cover panel of the container (or a flap connected thereto) and the receiving slot may be provided on the wall panel of the container.

The locking tab can include a base end portion connected to the wall panel of the container and a locking end portion extending from the base end portion. The locking end portion may include an outer terminal edge, which may define a terminal or outer edge, and an intermediate locking slit extending partially across the width of the locking tab at an intermediate position along its length. The intermediate locking slit may form an intermediate locking edge into the locking tab. The intermediate locking tab may include a transverse cut edge extending partially toward the outer terminal edge and an intermediate end fold line extending laterally toward the side edge of the locking tab. The formation of the intermediate locking edge may enable the locking tab to bend and fold relative to the remainder of the locking tab and form a tab end portion extending toward the outer terminal edge of the locking tab.

According to one embodiment, the receiving slot may include a receiving slit formed into the cover panel of the container. The receiving slit may form a receiving edge within the cover panel that is spaced from the front edge of the cover panel approximately the same distance that the intermediate locking edge on the locking tab is spaced from the upper edge of the wall panel. The receiving slot may further include one or more minor cut lines extending from the receiving slit.

The tamper evident feature may be enabled by folding the locking tab so that it is substantially aligned with the plane of the cover wall panel and inserting the terminal edge of the locking tab into the receiving slit of the receiving slot. The locking tab may then be further inserted into the receiving slot until the intermediate locking edge overlaps the receiving edge. The receiving edge and locking edge may then engage one another in order to interlock the locking tab and receiving slot together and restrict opening of the container. According to one embodiment, the transverse cut edges of the locking tab and the minor cut lines of the receiving slot enable the locking edge and receiving edge to interlock in a slightly overlapping manner to restrict the locking tab from being removed from the receiving slot with deformation of the locking tab or cover panel.

Both the intermediate locking edge of the locking tab and the receiving edge of the receiving slot may have a generally conforming curved shape that enables the locking edge and receiving edge to substantially align when the locking tab is inserted into the receiving slot.

According to one embodiment, the tamper evident feature may further include a restricting slot formed into the front edge of the cover panel. The locking tab may be inserted through the restricting slot prior to being folded and inserted into the receiving slot to further restrict removal of the locking tab from the receiving slot after engagement.

According to another embodiment, the tamper evident feature may include a locking tab connected to and extending from a cover panel of a container (or a flap connected thereto) and a receiving slot provided on a wall panel of the container. The locking panel may be configured to be at least partially inserted into the receiving slot and interlock with the receiving slot in order to secure the container in a closed position in a manner similar to the embodiment described above.

Other aspects and advantages of the present invention will be apparent from the following detailed description of the preferred embodiments of the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1A:
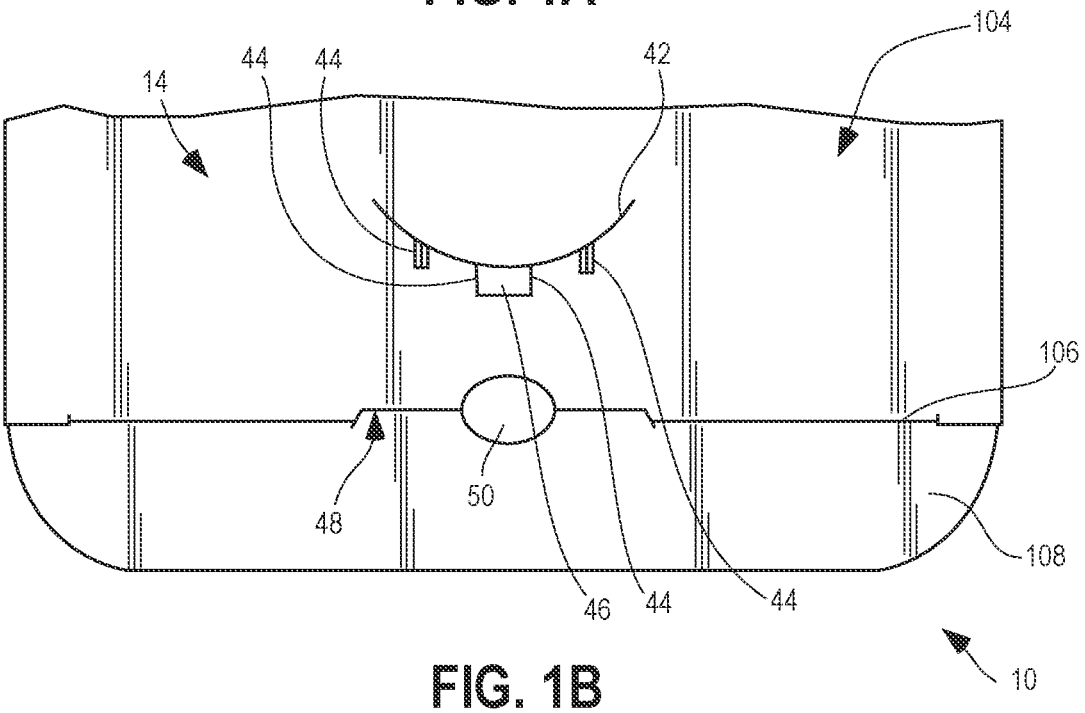
FIG. 1A is a schematic plan view of a receiving slot component of a tamper evident feature for a container in accordance with a first embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized, and changes can be made without departing from the scope of the present invention. The present invention is defined by the appended claims and the description is, therefore, not to be taken in a limiting sense and shall not limit the scope of equivalents to which such claims are entitled.

The present invention is directed to a tamper evident locking feature 10 for a container, carton, box or similar type of selectively enclosable structure. The present invention is also directed to a tamper evident food container 100 incorporating a tamper evident locking feature 10. Among a number of potential advantageous uses, tamper evident locking feature 10 and container 100 of the present invention may be utilized by food service providers in connection with transportation, delivery and storage of food items, and particularly with food delivery services to indicate whether a food container has been opened prior to completion of the delivery. As described herein, tamper evident locking feature 10 can be engaged with a lid or cover of a container so that the only way to open the container and gain access to the interior contents of the container is to tear or deform components of the tamper evident locking feature 10 and/or a portion of the container, each of which provides clear evidence that the container has been opened or tampered with. The engagement of tamper evident feature 10 may be hidden from sight so that it is not clearly visible that the container is locked. According to one embodiment, the engagement of tamper evident feature 10 can be achieved by pressing down and listening for an audible "click" as described in greater detail below. This can let the food operator know that the container has been closed and locked properly using tamper evident locking feature 10. According to one embodiment, tamper evident locking feature 10 can be incorporated into the layout of a container and no additional or secondary materials are needed to achieve tamper evidence. While the following description refers to one type of container in which tamper evident feature 10 can be incorporated, it is recognized that tamper evident locking feature 10 may be incorporated into any suitable type of container or similar vessel of any suitable design, shape, and size.

Figure 1B:
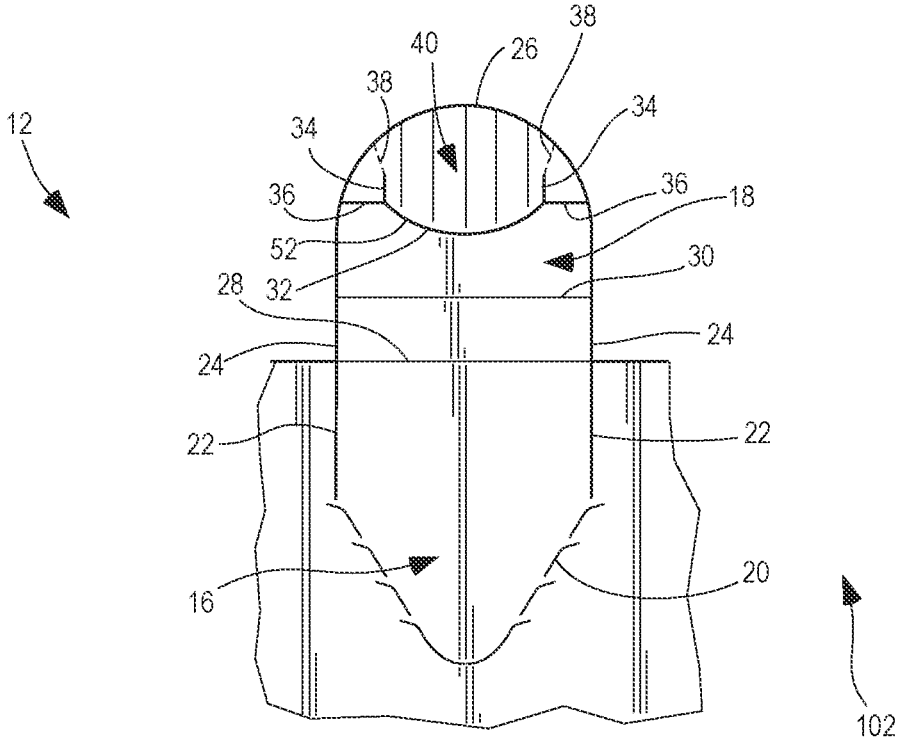
FIG. 1B is a schematic plan view of a locking tab component of a tamper evident feature for a container in accordance with the first embodiment of the present invention.
Figure 2:
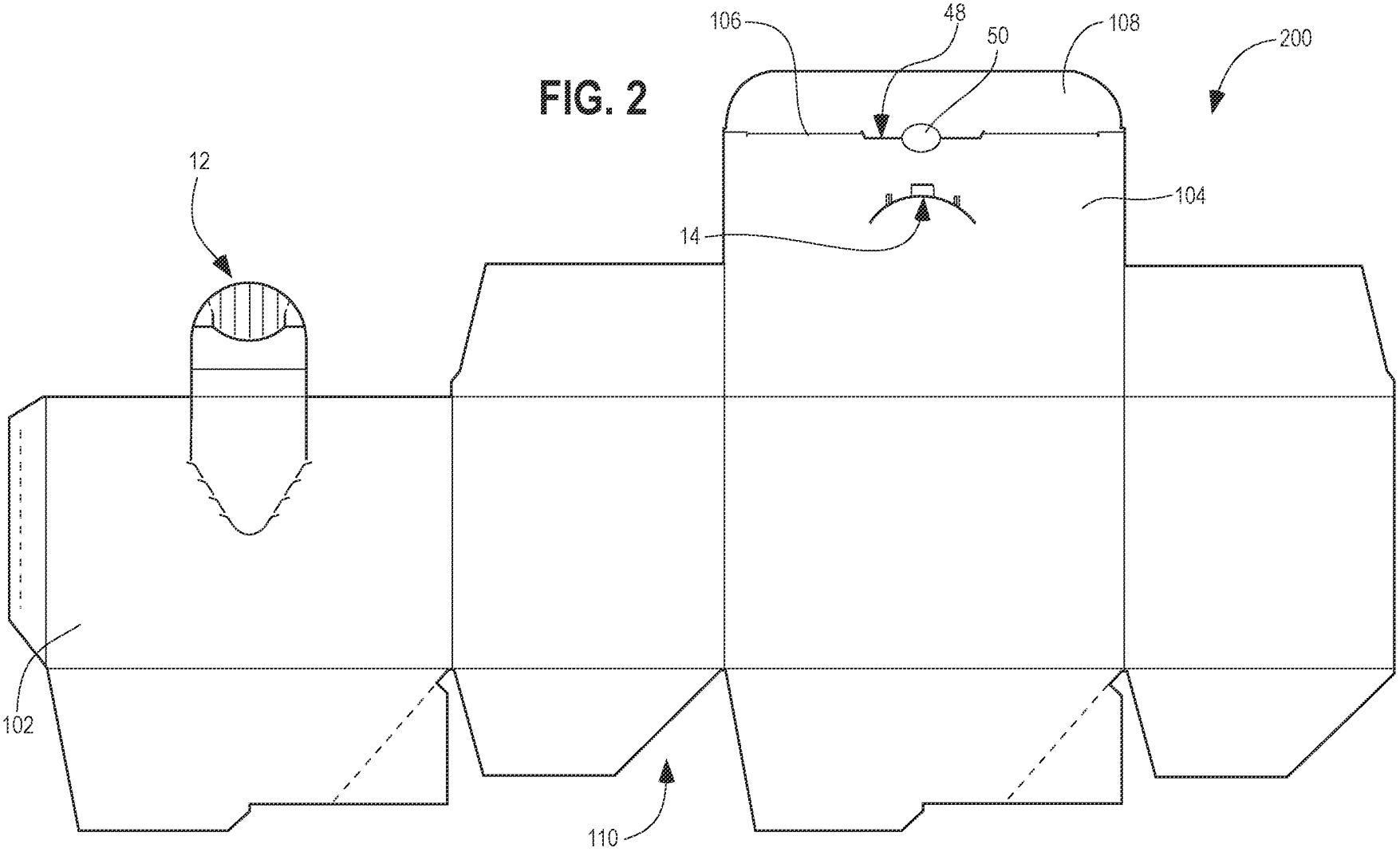
FIG. 2 is a schematic plan view of a blank for a container with a tamper evident feature in accordance with the first embodiment of the present invention.

FIGS. 1A and 1B schematically illustrate tamper evident feature 10 according to one embodiment of the present invention and incorporated into a closable container having a sidewall panel 102 and cover panel 104. FIG. 2 schematically illustrates a blank 200 for a container 100 that includes tamper evident locking feature 10 according to another embodiment. As best shown in FIGS. 1A and 1B, tamper evident feature 10 may include a locking tab 12 extending from a sidewall 102 of container 100 (see FIG. 1B) and a receiving slot 14 defined into top panel 104 of a container 100 (see FIG. 1A). As described in greater detail below, locking tab 12 may be configured to be inserted into receiving slot 14 in an interlocking fashion in order to secure sidewall 102 and top panel 104 together and the container in a closed configuration.

As shown in FIG. 1B, locking tab 12 may include a base end portion 16 and locking end portion 18. Base end portion 16 may be defined by a base edge 20 connected to sidewall 102 of the container. FIG. 1B illustrates base edge 20 connected to the container an intermediate position within sidewall 102; however, in alternative embodiments, base edge 20 may also be suitably connected to an edge of sidewall 102. According to one embodiment, base edge 20 may be removably connected to sidewall 102 by a perforated, scored or other type of weakened connection so that base edge 20 may be selectively removed from container sidewall 102. As described in greater detail below, this configuration can enable a user to open the container after tamper evident locking feature 10 has been engaged.

As shown in FIG. 1B, base end portion 12 may include base side edges 22 extending from base edge 20 and further defining the outer perimeter boundary of base end portion 10 (and locking tab 12 overall). According to one embodiment, as shown in the figures, base side edges 22 may be cut away from container sidewall 102, which may allow locking tab 12 to further flex and bend when engaging tamper evident feature 10. In alternative embodiments (not shown), base side edges 22 may be integral with or otherwise connected to container sidewall 102.

As shown in FIG. 1B, locking end portion 18 of locking tab 12 may extend from base end portion 16. As illustrated, locking tab 12 may be formed as a unitary component with locking end portion 18 and base end portion 16 integrally connected. Locking end portion 18 may include side edges 24 extending from base side edges 22 and a terminal free edge 26 extending between side edges 24 to define the perimeter boundary of locking end portion 18. The embodiment illustrated in FIG. 1B shows terminal free edge 26 having a semi-circular or curved shape that may facilitate the insertion of locking end portion 18 into receiving slot 14 as described below; however, terminal free edge 26 may have any suitable shape or configuration in alternative embodiments of the present invention.

As further shown in FIG. 1B, extending between side edges 24 at intermediate positions along the length of locking tab 12 may be first and second intermediate scored or fold lines 28 and 30. Intermediate fold lines 28 and 30 may be configured to enable flexing and bending of locking tab 12 to facilitate the engagement of tamper evident locking feature 10. According to one embodiment, first intermediate fold line 28 may be generally aligned and coextensive with the upper edge of container sidewall 102 so that locking tab 12 may be folded and generally aligned with the plane of cover panel 102 when cover panel 102 is folded down into a closed position. According to one embodiment as shown in FIG. 1B, second intermediate fold line 30 may be slightly spaced apart from first intermediate fold line 28 in the direction of terminal free edge 26 and may facilitate insertion of locking tab 12 into receiving slot 14 (shown in FIG. 1A) by allowing locking tab 12 to be oriented in a slightly downward angle.

As shown in FIG. 1B, locking end portion 18 may include an intermediate locking slit 52 defined into and through the surface of locking tab 12 to form a corresponding intermediate locking edge or intermediate cut edge 32. As shown in FIG. 1B, intermediate locking edge 32 may be intermediately located along a portion of the width of locking tab 12 between side edges 24 and between second intermediate fold line 30 and terminal edge 26. Intermediate locking slit 52 and corresponding edge 32 may be configured as a cut, slit, incision or similar opening defined through the surface of locking tab 12. As shown in FIG. 1B, intermediate locking edge 32 may not extend across the entire width of locking tab 12 and may have a generally curved shape. As further shown in FIG. 1B, intermediate locking edge 32 may include transverse extension cut ends 34 located at each end of the curved portion of intermediate locking edge 32 and extending generally perpendicular to the curved portion of intermediate locking edge 32. As described in greater detail below, intermediate locking edge 32 (including extension cut ends 34) may function as a locking component of tamper evident feature 10 when locking tab 12 and receiving slot 14 are engaged.

As shown in FIG. 1B, locking end portion 18 may further include a fold or score end line 36 extending laterally away from each end of intermediate locking edge 32 to side edges 24 of locking end portion 18. Folding end edges 36 (along with intermediate locking slit 52 and corresponding edge 32) can enable the locking end portion 18 to flex and pivot with respect to the remainder of locking tab 12. As further shown in FIG. 1B, locking end portion 18 may include perforated, weakened, or scored tear-away lines 38 extending from transverse extension cut ends 34 (of intermediate locking edge 32) to terminal edge 26. As described in greater detail below, once locking tab 12 is engaged with receiving slot 14 to form tamper evident locking feature 10, scored tear-away lines 38 can assist in preventing locking tab 12 from being removed from receiving slot 14 without deformation of locking tab 12.

As also shown in FIG. 1B, locking end portion 18 may further include an end section 40 that may be configured to be inserted into and received by receiving slot 14 (as described in greater detail below). According to one embodiment as shown in FIG. 1B, end section 40 may include one or more ribbed extensions or fingers extending away from intermediate locking edge 32 to terminal edge 26. As best shown in FIG. 1B, the perimeter end section 40 may be defined by intermediate locking edge 32 and terminal edge 26 at each end and by transverse cut ends 34 and scored tear-away lines 38 along its sides. The ribbed extensions of end section 40 may be defined into tab 12 by means of scoring, perforation, indentation, surface marking or other means and can operate to stiffen and/or strengthen locking end portion 18 to reduce bending or deformation of locking end portion 18 once tamper evident feature 10 is engaged (as described below).

As shown in FIG. 1A, receiving slot 14 of tamper evident feature 10 may be defined into the top or cover panel 104 of the container. As described in greater detail below, receiving slot 14 may be configured to fully or partially receive locking end portion 18 of locking tab 12 when tamper evident feature 10 is engaged. As such, receiving slot 14 may be located at a position within top or cover panel 104 corresponding to the approximate length and position of locking tab 12 so that locking tab 12 may be inserted into receiving slot 14 to engage tamper evident feature 10. According to one embodiment, receiving slot 14 is positioned inward from the front edge 106 of cover panel 104 at a distance approximately equal to the distance intermediate locking slit 52 and corresponding edge 32 located on locking tab 12 extend away from an upper edge of front panel 102.

As best shown in FIG. 1A, receiving slot 14 may include a slit defined into and through the surface of cover panel 104 to form a corresponding receiving cut edge 42. As shown in FIG. 1A, receiving cut edge 42 may be intermediately positioned within cover panel 104 at a distance from the front edge 106 of cover panel 104 corresponding to the distance intermediate locking edge 32 of locking tab 12 is spaced from the upper edge of front wall panel 102 to enable end section 40 to be inserted within receiving slot 14. Receiving slit and corresponding receiving cut edge 42 may be configured as a cut, slit, incision or similar opening defined through the surface of cover panel 104.

According to one embodiment as shown in FIG. 1A, receiving slit and corresponding edge 42 may have a curved shape with the curvature extending away from the front edge 106 of cover panel 104. As described in greater detail below, the curvature of receiving slit and edge 42 may facilitate engagement of locking tab 12 with receiving slot 14. As further shown in FIG. 1A, the curvature of receiving cut edge 42 may generally correspond to and conform to the curvature of intermediate locking slit 52 and corresponding edge 32 (of locking tab 12) as shown in FIG. 1B. This corresponding curvature between edge 42 and edge 32 facilitate an overlapping and interlocked engagement when tamper evident feature 10 is enabled after locking tab 12 is inserted into receiving slot 14. It is further recognized that the receiving slit and cut edge 42 may have a linear, curved or other suitable shape and configuration in alternative embodiments of the present invention as long as the configuration enables locking tab 12 to be at least partially inserted through receiving slot 14.

As shown in FIG. 1A, receiving slot 14 may further include one or more minor cut lines 44 extending away from receiving cut edge 42. According to one embodiment, minor cut lines 44 (along with curved edge 42), may form one or more deflecting tabs or portions 46 along the convex side of curved edge 42. In one embodiment, a generally perpendicular or lateral cut line or score line may be provided at or intersect with a distal end of one or more minor cut lines 44. During engagement of tamper evident feature 10, deflecting tabs 46 may assist in maintaining the locked engagement of feature 10 and may deflect downward and engage with intermediate locking edge 32 to further prevent locking tab 12 from disengaging from receiving slot 14.

As further illustrated in FIG. 1A, tamper evident feature 10 may also include a restraining slot 48 defined into the folded edge 106 of cover or top panel 104 of the container. As shown in FIG. 1A, folded edge 106 may form the connecting edge between cover panel 104 and a front fold flap 108 and restraining slot 48 may be generally aligned with the location of locking tab 12. Restraining slot 48 may be configured to allow locking tab 12 to be inserted therethrough prior to being inserted into receiving slot 14 and tamper evident locking feature 10 being engaged and locked as described in greater detail below. The restraining slot 48 may further include a cut-out 50 to more easily allow locking tab 12 to be inserted therethrough. FIG. 1A shows cut-out 50 having an oval shape that may facilitate the insertion of locking tab 12 into restraining slot 48; however, cut-out 50 may have any suitable shape or configuration in other embodiments of the present invention. Once locking tab 12 is inserted through restraining slot 48, restraining slot 48 may function to limit the range of motion of locking tab 12 and restrict the ability to remove tab 12 from receiving slot 14 once inserted therein.

Figure 3:
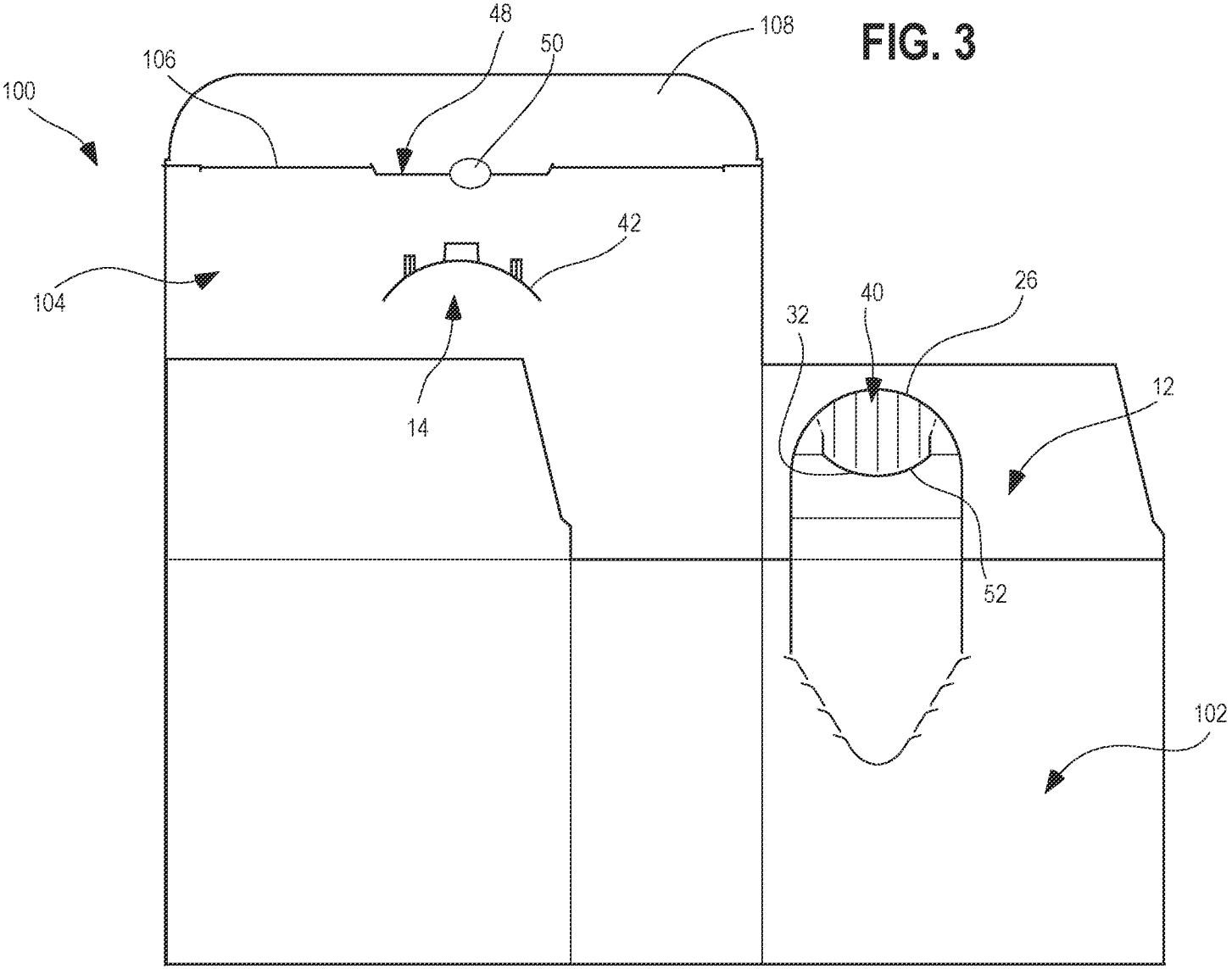
FIG. 3 is a plan view of a container with a tamper evident feature illustrating the container in a folded configuration in accordance with the first embodiment of the present invention.

As shown in FIGS. 2 and 3, tamper evident feature 10 may be incorporated into a container 100 formed from a foldable unitary blank 200. FIG. 2 illustrates blank 200 prior to being formed into container 100 according to one embodiment, while FIG. 3 illustrates container 100 formed from blank 200 and in a folded and flat configuration. As best shown in FIG. 2, container 100 may include one or more wall panels connected together at their ends, including a first or front sidewall panel 102. As further shown in FIG. 2, container 100 may include one or more cover flaps and a top or cover panel 104 connected to an upper edge of a wall panel and configured to enclose the upper portion of container 100 when formed from blank 200. As further shown in FIG. 2, container 100 may include one or more bottom panels forming a bottom end construction 110. Container 100 and blank 200 as illustrated in FIGS. 2 and 3 (as well as FIGS. 4-11) represent just one embodiment of the container 100 of the present invention and it is recognized that container 100 may have any suitable configuration utilized in enclosable carton and container structures.

As described above and also illustrated in FIGS. 2 and 3, container 100 includes tamper evident feature 10 incorporated therein. According to one embodiment, as illustrated in FIGS. 2 and 3, locking tab 12 of tamper evident feature 10 may be defined into and/or connected to first sidewall panel 102 and extend upward therefrom, while receiving slot 14 of tamper evident feature 10 may be defined into top panel 104. In addition, according to certain embodiments, container 100 may include a front fold flap 108 connected to cover panel 104 by folded edge 106, which may contain restraining slot 48 and cut-out 50 of tamper evident feature 10. Container 100 may further include additional features and/or configurations commonly found in carton and container constructions now known or hereinafter developed.

Figure 4:
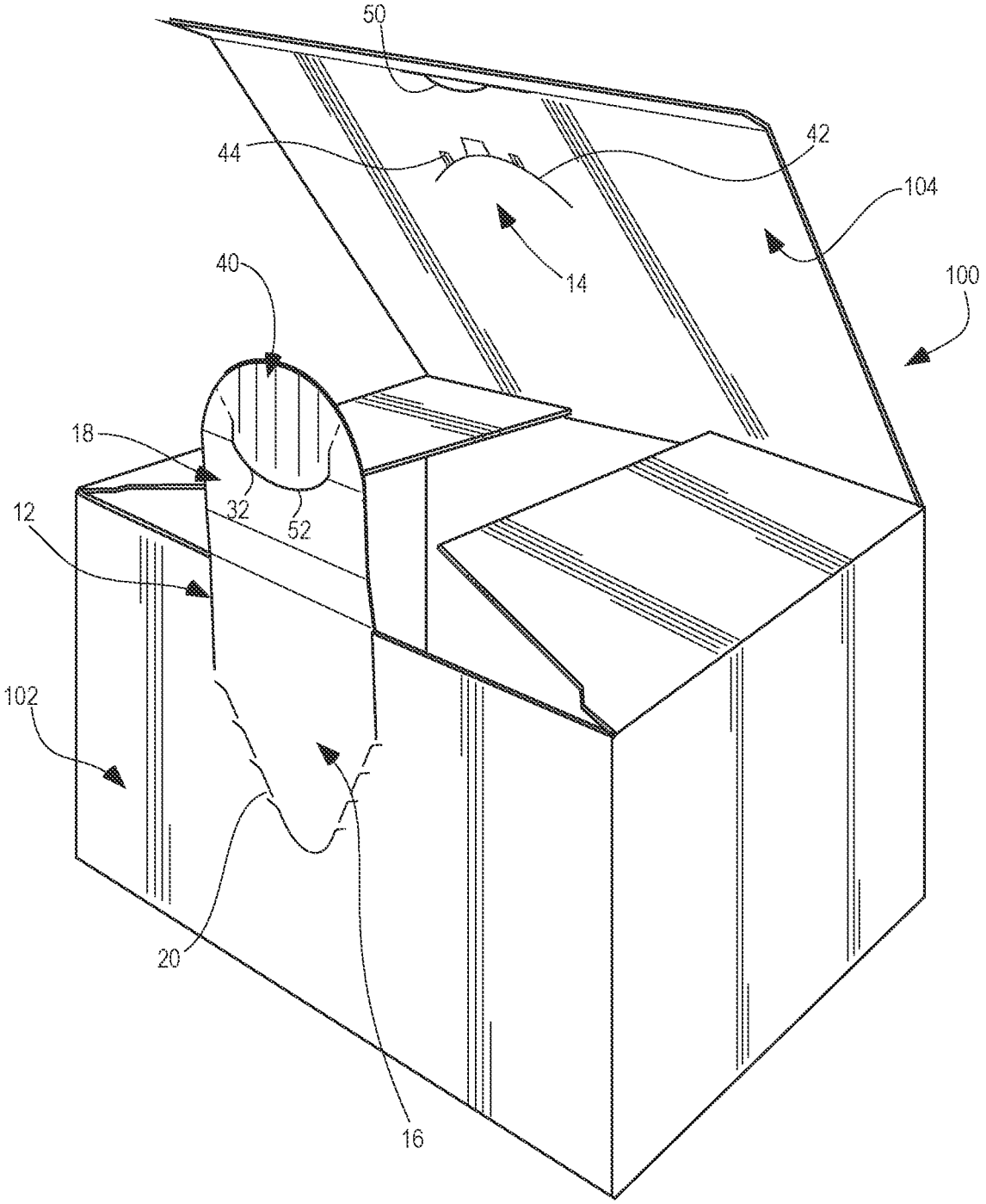
FIG. 4 is a perspective view of the container with tamper evident feature of FIG. 3 illustrating the container in an unfolded and opened configuration in accordance with the first embodiment of the present invention.

Turning to FIGS. 4-11, the use and configuration of tamper evident feature 10 and container 100 (with tamper evident feature 10 incorporated therein) according to one embodiment, is illustrated in greater detail. As shown in FIG. 4, prior to engaging tamper evident feature 10, cover panel 104 of container 100 may be freely opened and closed to provide access to the interior of container 100. As shown, prior to engagement of tamper evident feature 10, locking tab 12 freely extends from sidewall panel 102 and is disengaged from linear restraining slot 48 and receiving slot 14.

Figure 5:
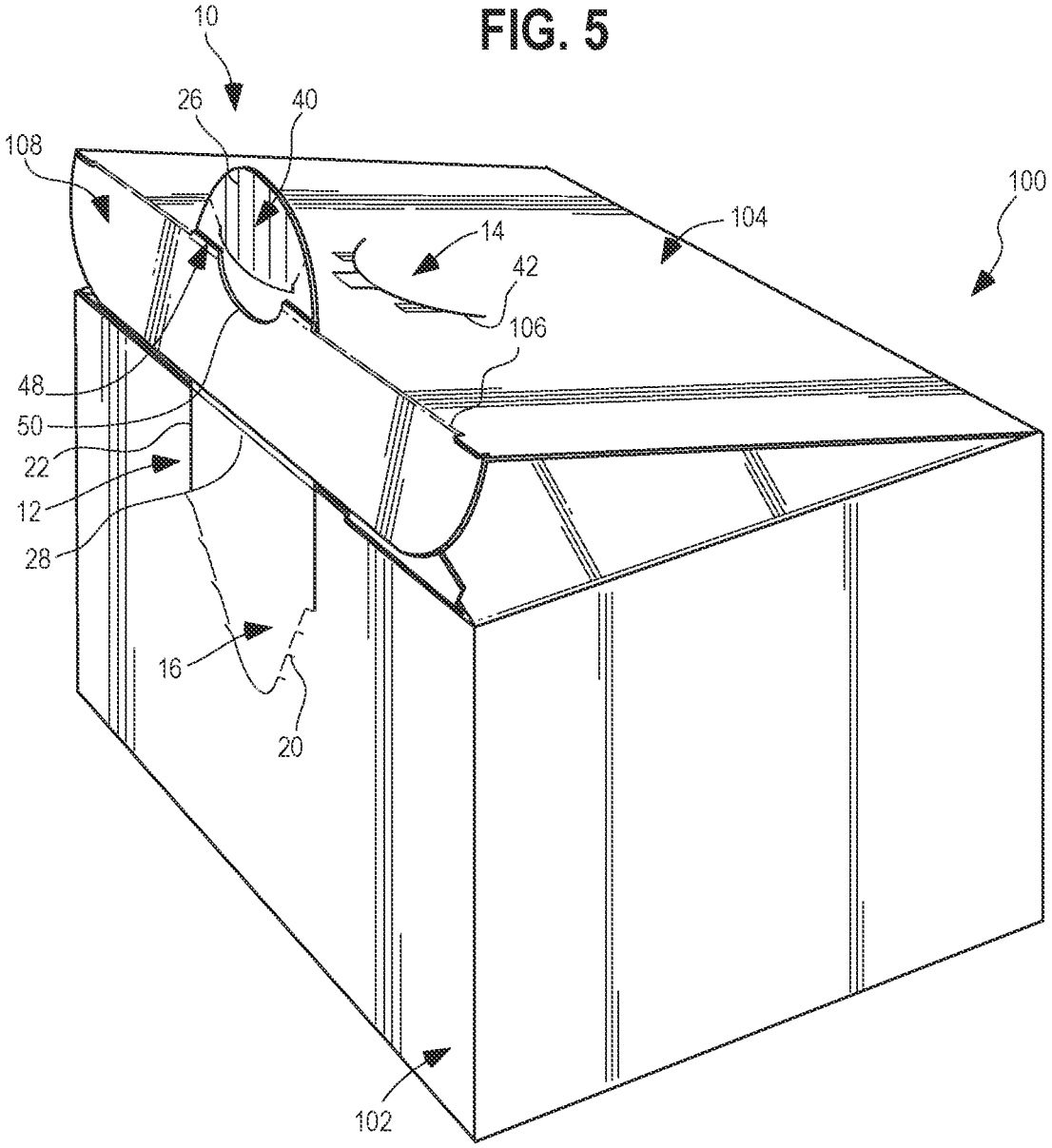
FIG. 5 is a perspective view of the container with tamper evident feature of FIG. 3 illustrating the container in a partially closed configuration in accordance with the first embodiment of the present invention.
Figure 6:
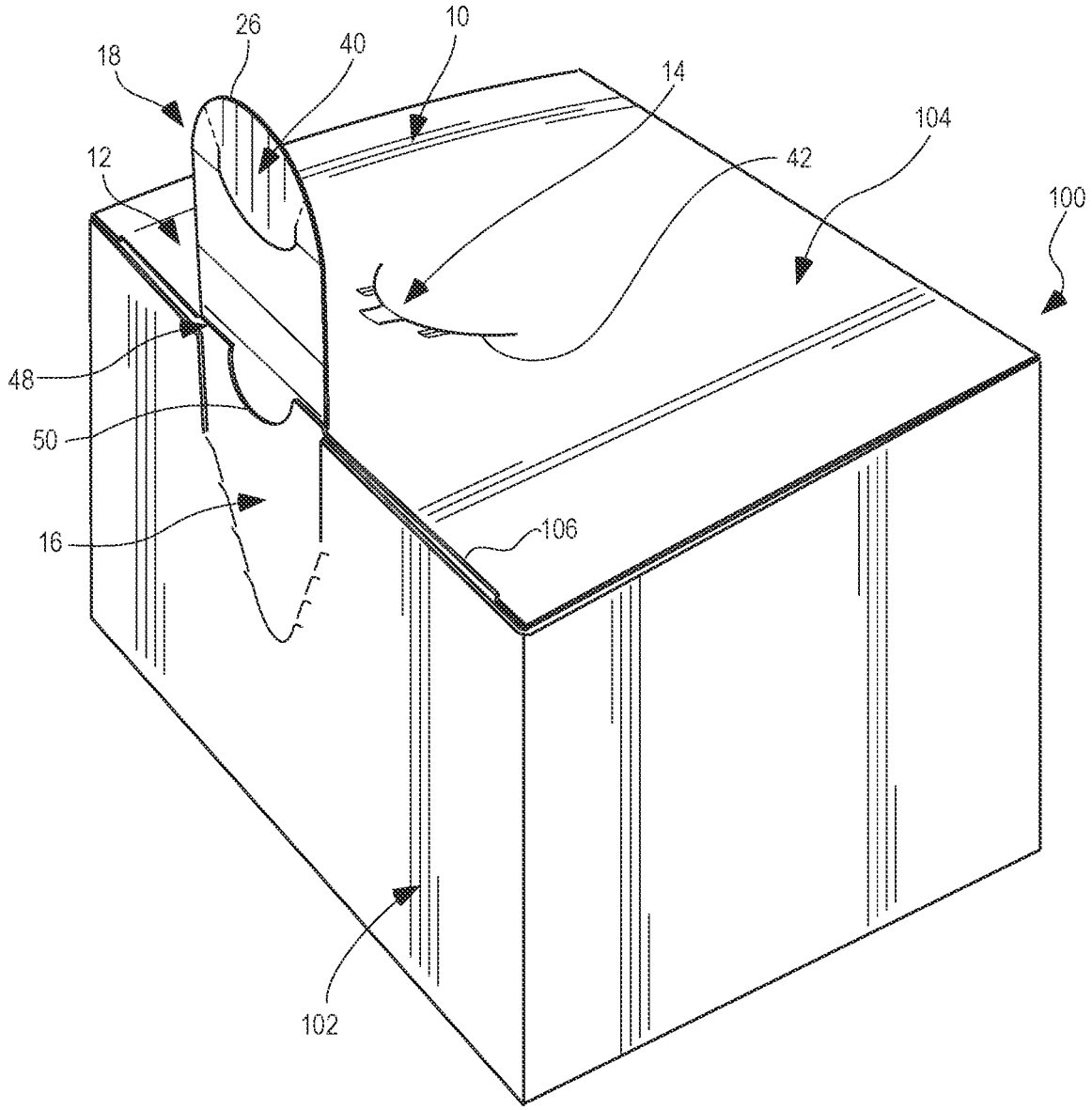
FIG. 6 is a perspective view of the container with tamper evident feature of FIG. 3 illustrating the container in a closed position in accordance with the first embodiment of the present invention.

As shown in FIG. 5, according to one embodiment where tamper evident feature 10 includes linear restraining slot 48, locking tab 12 may be inserted through slot 48 provided along the fold edge 106 between top panel 104 and fold flap 108 of container 100 to begin the engagement process of tamper evident feature 10. As shown, locking tab 12 may be inserted through slot 48 and then top panel 104 of the container 100 can be fully closed to enclose and seal in the contents located within the interior volume of container 100 (see FIG. 6).

Figure 7:
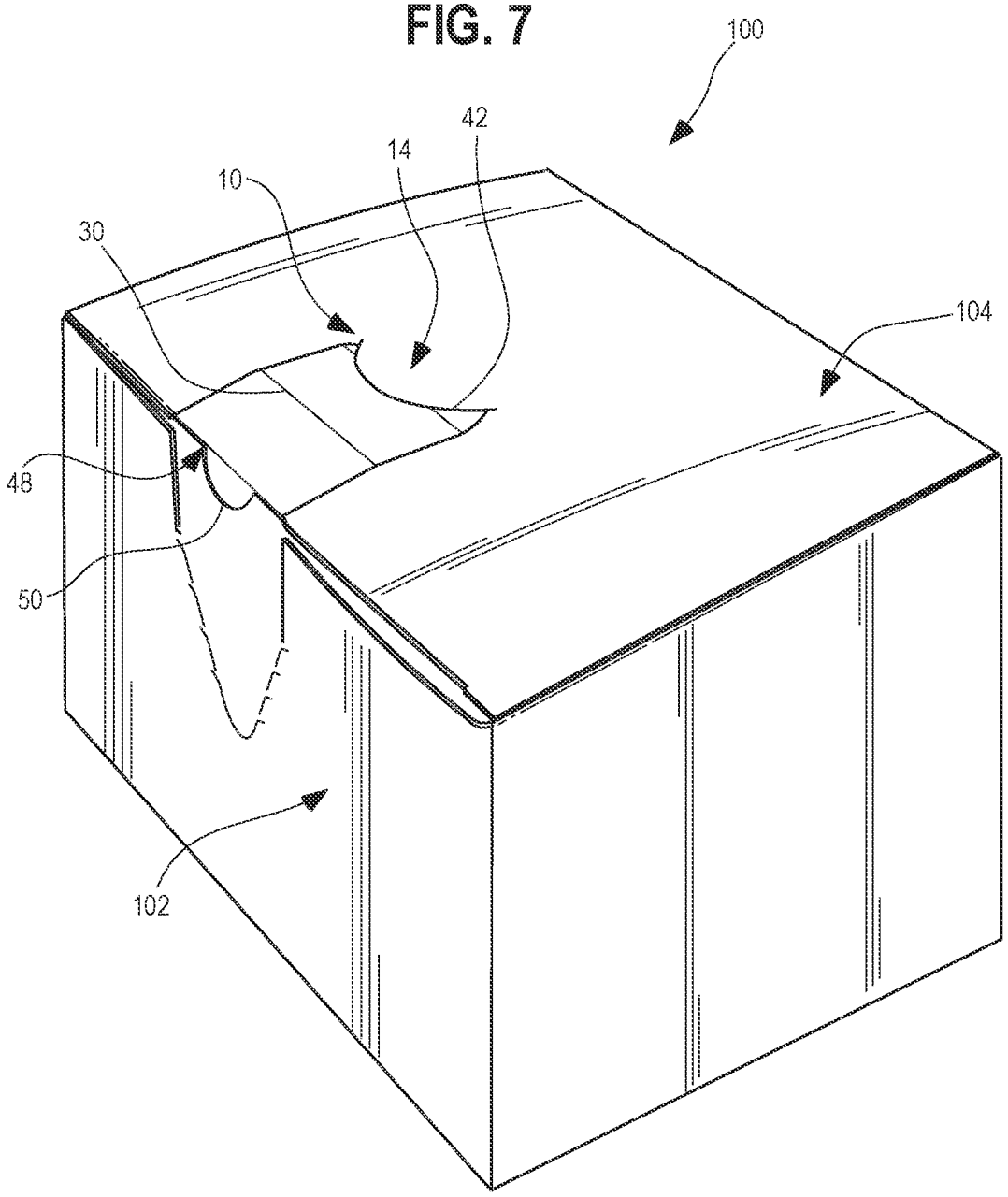
FIG. 7 is a perspective view of the container with tamper evident feature of FIG. 3 illustrating the container in a fully closed configuration with the tamper evident feature fully engaged in accordance with the first embodiment of the present invention.

FIG. 7 illustrates container 100 in a fully closed configuration where tamper evident feature 10 has been fully engaged and container 100 is restricted from opening without providing visible evidence of tampering. As shown, locking tab 12 has been inserted through restricting slot 48, folded over and the end section 40 of locking tab 12 has been inserted through receiving slot 14 so that intermediate locking edge 32 (of locking tab 12) and receiving cut edge 42 (of receiving slot 14) are interlocked together as described in detail below with reference to FIGS. 8-11).

Figure 8:
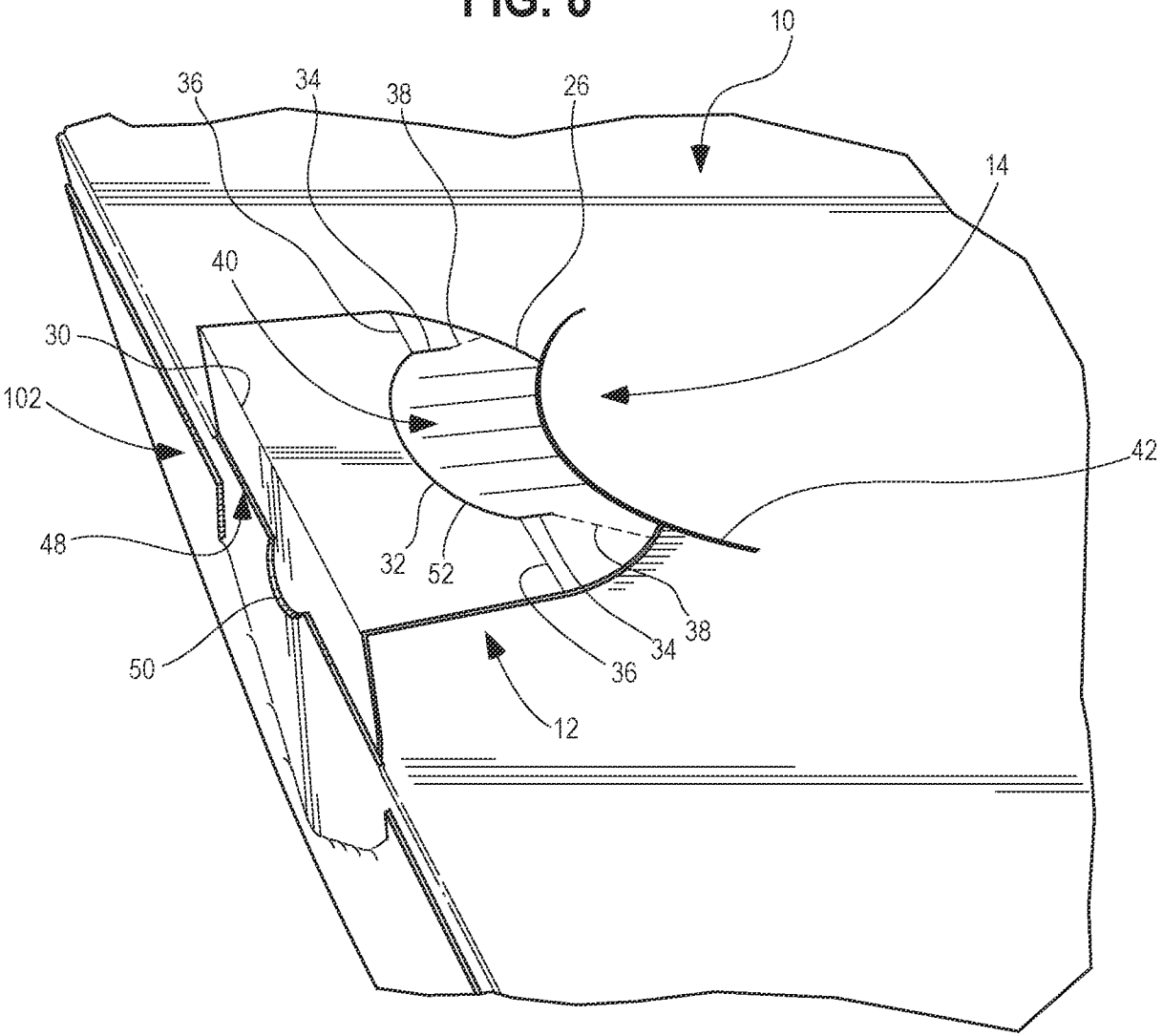
FIG. 8 is a partial perspective view of the container with tamper evident feature of FIG. 3 illustrating the initial engagement of the tamper evident feature in accordance with the first embodiment of the present invention.

As shown in FIG. 8, once cover panel is fully closed, locking tab 12 may be folded downward along first intermediate fold line 28 so that it generally overlies cover panel 104. As further shown in FIG. 8, the locking end portion 18 of locking tab 12 may be aligned with and inserted into receiving slot 14. When inserting locking tab 12 into receiving slot 14, the terminal edge 26 and ribbed end section 40 of locking end portion 18 may be pushed through receiving slit and cut edge 42 (of receiving slot 14) defined into cover panel 104. As shown in FIG. 8, locking tab 12 may be partially bent or folded along second intermediate fold line 30 and/or fold end lines 36 (adjacent intermediate locking edge 32) to facilitate inserting end section 40 into receiving slot 14 by allowing locking end portion 18 of locking tab 12 to have a slight downward angled orientation.

Figure 9:
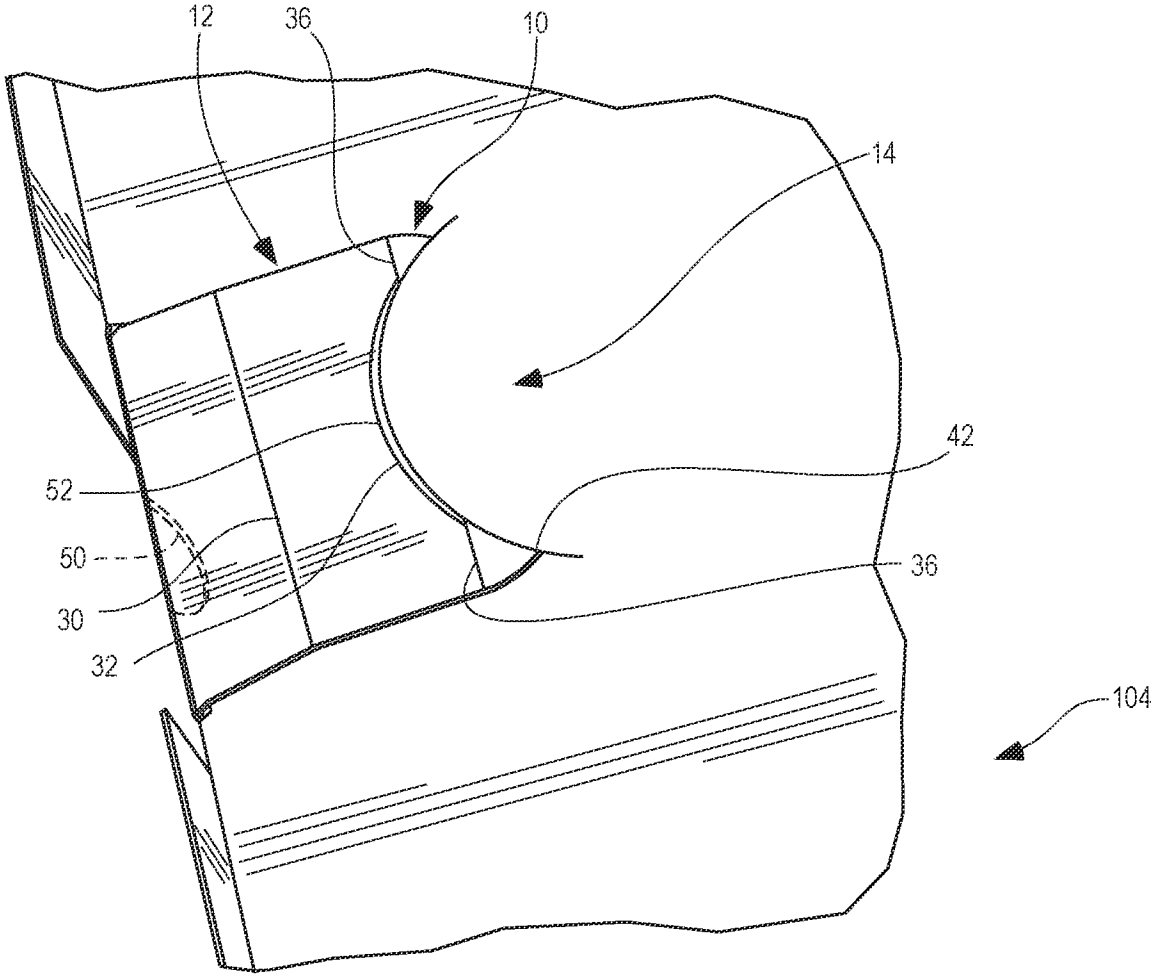
FIG. 9 is a partial perspective view of the container with tamper evident feature of FIG. 3 illustrating the partial engagement of the tamper evident feature in accordance with the first embodiment of the present invention.
Figure 10:
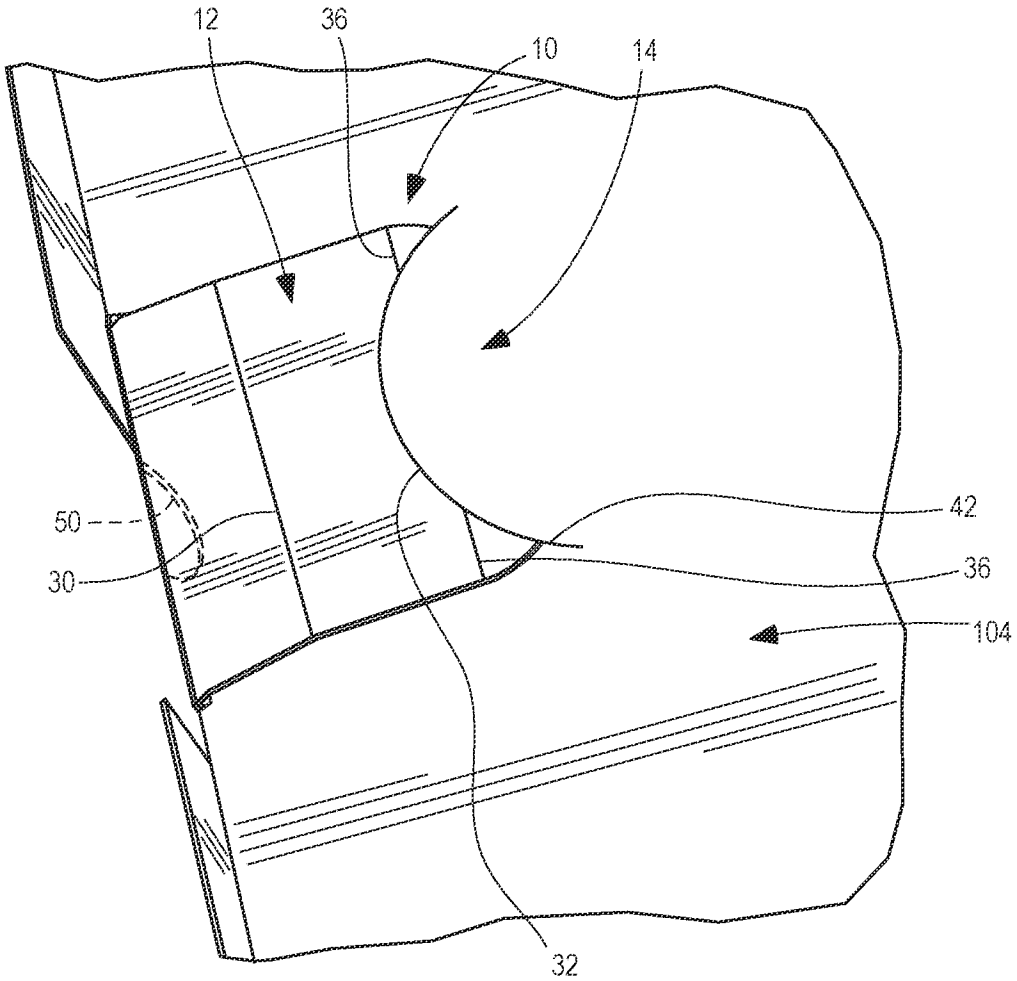
FIG. 10 is a partial perspective view of the container with tamper evident feature of FIG. 3 illustrating the full engagement of the tamper evident feature in accordance with the first embodiment of the present invention.
Figure 11:
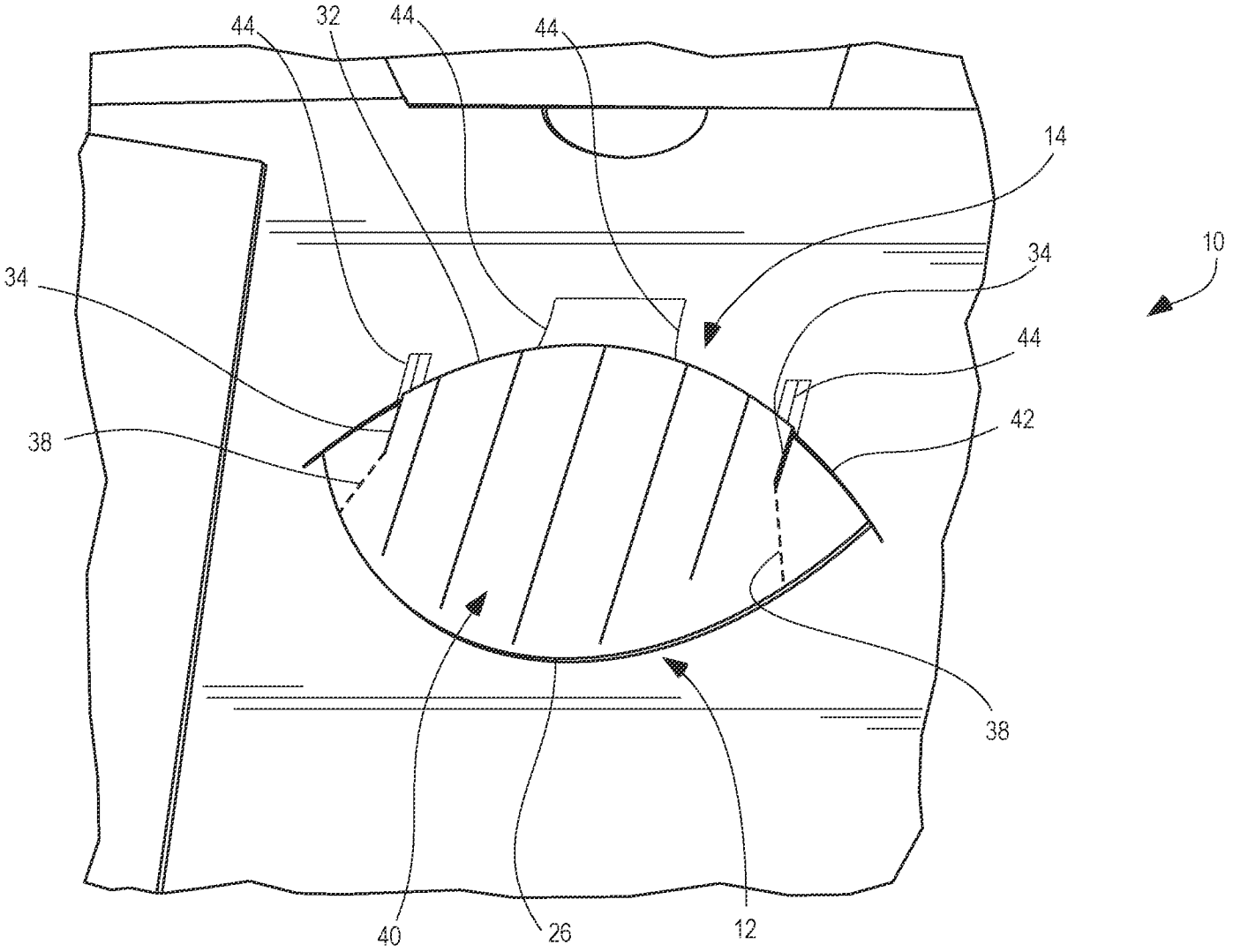
FIG. 11 is a partial perspective view of the interior of the container with tamper evident feature of FIG. 10 illustrating the full engagement of the tamper evident feature in accordance with the first embodiment of the present invention.

As shown in FIGS. 9-11, in order to fully engage tamper evident feature 10, locking tab 12 may be inserted into receiving slot 14 until terminal edge 26 and ribbed end section 40 is inserted past receiving cut edge 42 and fully through receiving slot 14. Once terminal edge 26 and ribbed end section 40 are fully inserted through slot 14, intermediate locking edge 32 on locking tab 12 may be positioned just beyond receiving cut edge 42 of receiving slot 14 (as best illustrated in FIGS. 10 and 11). According to one embodiment, as shown in the figures, receiving slot 14 may be positioned within cover panel 104 so that the distance from the apex of receiving cut edge 42 (of receiving slot 14) to linear restraining slot 48 (defined into the folded edge 106 connecting cover panel 104 and front fold flap 108) is approximately equal to and/or slightly less than the distance between the apex of curved intermediate locking edge 32 and first intermediate fold line 28 of locking tab 12. This configuration can enable tamper evident feature 10 to securely lock by allowing locking tab 12 to be inserted into receiving slot 14 so that intermediate locking edge 32 of locking tab 12 extends just beyond receiving cut edge 42 of receiving slot 14. As described above, intermediate locking edge 32 may also generally conform in shape and curvature to receiving cut edge 42 of receiving slot 14 so that when end section 40 of locking tab 12 is fully inserted within receiving slot 14, intermediate locking edge 32 and receiving cut edge 42 are substantially aligned and the entirety of intermediate locking edge 32 may be positioned just beyond receiving cut edge 42.

As best shown in FIG. 10, once locking tab 12 is partially inserted through receiving slot 14, the terminal edge 26 and ribbed end section 40 located along the outer portion of locking tab 12 are positioned underneath top panel 104 of container 100 and no longer accessible from the exterior of container 100. When locking tab 12 is fully inserted through receiving slot 14, intermediate locking edge 32 on locking tab 12 may be positioned below and engage with the receiving cut edge 42 of receiving slot 14. The engagement may be enabled and facilitated by the configuration of transverse cut ends 34 extending from intermediate locking edge 32 on each end of intermediate locking edge 32, which allow intermediate cut edge 32 to deflect downward and slide past receiving cut edge 42 of receiving slot 14.

According to this embodiment, when locking tab 12 is first inserted to receiving slot 14, locking tab 12 may be positioned in a first engagement position where intermediate locking edge 32 is pushed forward just beyond receiving cut edge 42 of receiving slot 14. Locking tab 12 may then be pressed downward into a second engagement position where intermediate locking edge 32 is positioned slightly below or under receiving cut edge 42 of receiving slot 14. Finally, locking tab 12 may slightly retract from the forward position into a third engagement position where intermediate locking edge 32 (and the edge of end section 40) is located underneath and just prior to receiving cut edge 42 of receiving slot 14.

As described above, transverse cut ends 34 of intermediate locking edge 32 enable intermediate locking edge 32 (and the edge of end section 40) to move from the second engagement position to the third engagement position by providing a slot or opening at each end of the curved portion of intermediate locking edge 32 to partially receive receiving cut edge 42 of receiving slot 14. In accordance with this configuration, intermediate cut edge 32 slides slightly beyond receiving cut edge 42 when end section 40 of locking tab 12 is fully inserted into receiving slot 14, and then subsequently slides or retracts backward with intermediate locking edge 32 (and the edge of end section 40) being positioned underneath receiving cut edge 42 (and cover panel 104) as transverse cut ends 34 slightly receive receiving cut edge 42.

According to one embodiment, once locking tab 12 is fully inserted into receiving slot 14 and intermediate locking edge 32 of locking tab 12 is positioned just beyond receiving cut edge 42 of receiving slot 14, a downward pressure may be applied to receiving slot 14 (along the concave side of receiving cut edge 42) which can cause intermediate cut edge 32 of locking tab 12 to slide below and engage with receiving cut edge 42 to fully lock and engage tamper evident feature 10.

FIG. 11 illustrates an interior view from the interior of container 100 after locking tab 12 has been fully engaged with receiving slot 14. As described above, after partially inserting locking tab 12 through receiving slot 14, locking tab 12 can continue to be pressed through slot 14 until intermediate locking edge 32 of locking tab 12 is approximately aligned with receiving cut edge 42 of receiving slot 14 on top panel 104 (i.e., the first engagement position). Once aligned, a downward force or pressure can be applied to the curved receiving slot 14 which can cause intermediate cut edge 32 of locking tab 12 to move below (i.e., the second engagement position) and then engage with receiving cut edge 42 (i.e., the third engagement position). When transitioning from the second engagement position to the third engagement position, minor cut lines 44 on receiving slot 14 may also engage the transverse cut ends 34 extending toward terminal edge 26 of locking tab 12 as best illustrated in FIG. 11. This process of applying the downward force or pressure on curved receiving slot 14 may also result in an audible "clicking" sound that can notify a food operator that locking tab 12 and receiving slot 14 of the tamper evident feature 10 have been interlocked and engaged.

As shown in FIG. 11, when in the third engagement position and tamper evident feature 10 is fully engaged, intermediate locking edge 32 of locking tab 12 is positioned below receiving cut edge 42 and slightly beyond receiving cut edge 42 in the direction of the front edge or folded edge 106 of cover panel 104 so that intermediate locking edge 32 and receiving cut edge 42 are slightly offset from one another. In this position, intermediate locking edge 32 and receiving cut edge 42 can become engaged and can restrict locking tab 12 from disengaging receiving slot 14.

Once the locking tab 12 is fully engaged with the receiving slot 14 (and intermediate locking edge 32 is engaged with receiving cut edge 42 of receiving slot 24), locking tab 12 may be restricted from disengaging with receiving slot 14 without tearing or deforming locking tab 12 and/or receiving slot 14. According to one embodiment, scored tear-away lines 38 extending from the transverse cut ends 34 of intermediate locking edge 32 to terminal edge 26 of locking tab 12 provide points or lines of weakness when locking tab 12 is attempted to be disengaged from receiving slot 14 after tamper evident feature 10 is enabled. In the event a user attempts to remove locking tab 12 from receiving slot 14, the intermediate locking edge 32 (including cut ends 34) become further interlocked with receiving cut edge 42 of receiving slot 14. This interlocking engagement between intermediate locking edge 32 and receiving cut edge 42 restricts locking tab 12 from exiting receiving slot 14 unless sufficient force is applied to scored tear-away lines 38 and ribbed end section 40 is separated from the remainder of locking tab 12. This has the effect of creating a tamper evident indicator if container 100 is opened after the tamper evident locking feature has been engaged.

FIGS. 12A-21 illustrate another embodiment of the present invention in which the locations of locking tab 12 and receiving slot 14 relative to front sidewall panel 102 and top panel 104 are generally reversed. As shown in FIGS. 12A-21, in this embodiment, locking tab 12 extends from front fold flap 108 of top panel 104, differing from the previous embodiment where locking tab 12 extends from sidewall 102. Similarly, receiving slot 14 is defined into sidewall 102, differing from the previous embodiment where receiving slot 14 was defined into top panel 104.

Figure 12A:
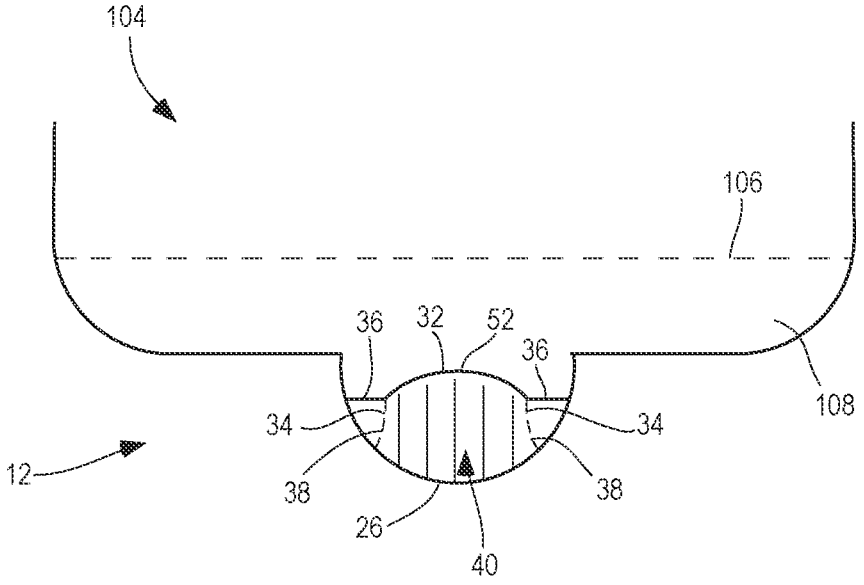
FIG. 12A is a schematic plan view of a locking tab component of a tamper evident feature for a container in accordance with a second embodiment of the present invention.
Figure 12B:
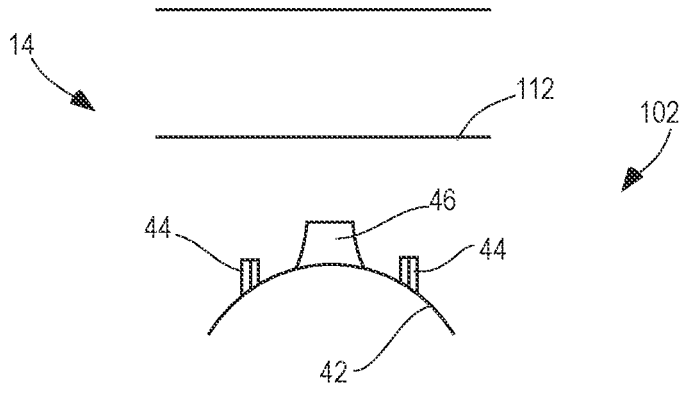
FIG. 12B is a schematic plan view of a receiving slot component of a tamper evident feature for a container in accordance with the second embodiment of the present invention.
Figure 13:
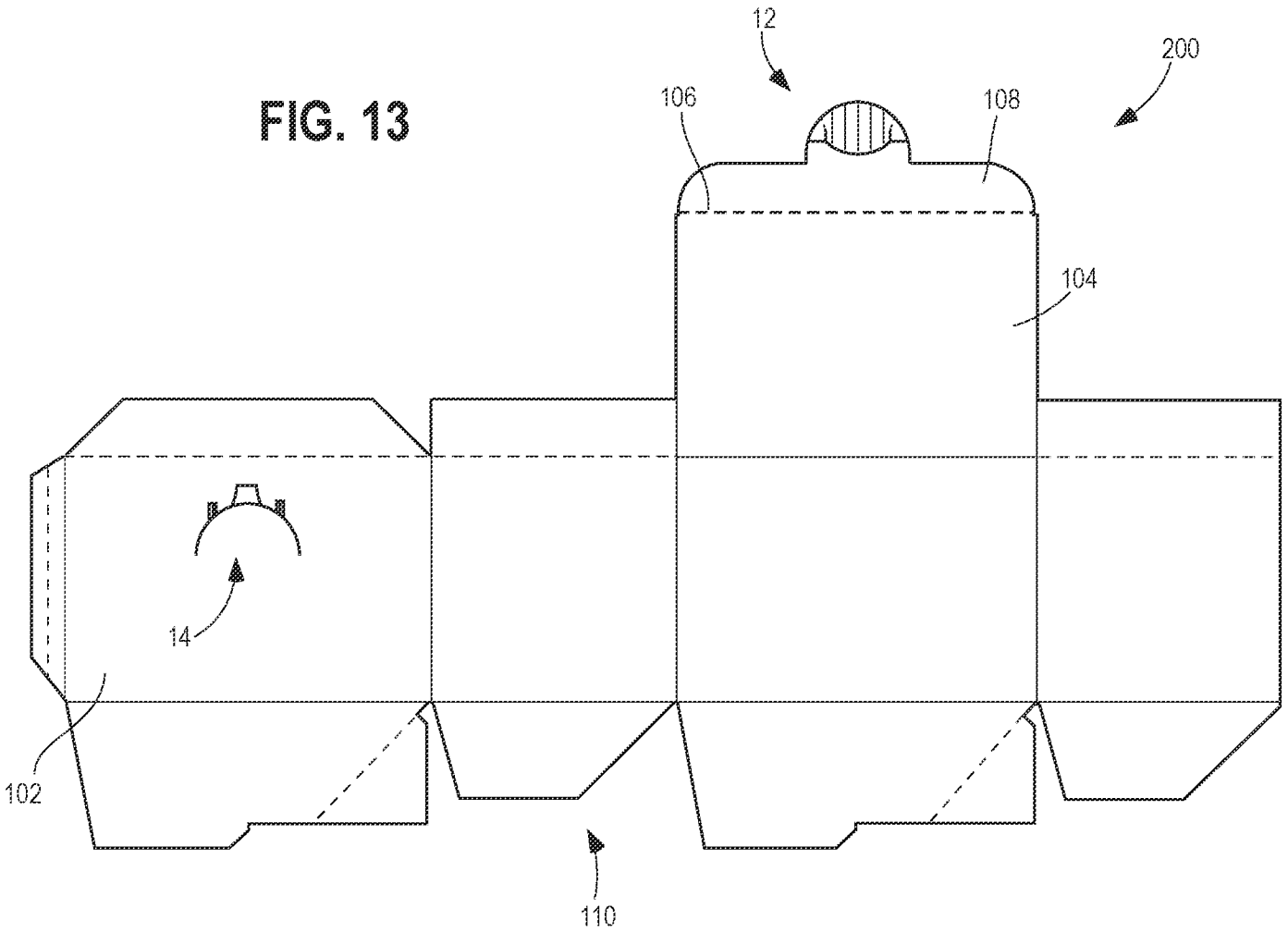
FIG. 13 is a schematic plan view of a blank for a container with a tamper evident feature in accordance with the second embodiment of the present invention.

FIGS. 12A and 12B schematically illustrate tamper evident feature 10 according to another embodiment of the present invention and incorporated into a closable container having sidewall panel 102 and cover panel 104. FIG. 13 schematically illustrates blank 200 for container 100 that includes tamper evident locking feature 10 according to this embodiment. Container 100 according to this embodiment may additionally include a front fold flap 108 connected to cover panel 104 by folded edge 106. As best shown in FIGS. 12A and 12B, tamper evident feature 10 may include locking tab 12 extending from front fold flap 108 of top panel 104 of container 100 (see FIG. 12A) and receiving slot 14 defined into sidewall panel 102 of container 100 (see FIG. 12B). As described in greater detail below, locking tab 12 may be configured to be inserted into receiving slot 14 in an interlocking fashion in order to secure sidewall 102 and top panel 104 together and the container in a closed configuration.

As shown in FIG. 12A, locking tab 12 according to the alternative embodiment may be connected to and/or extending from cover panel 104 or front fold flap 108 of cover panel 104. Locking tab 12 may be a separately formed component connected to cover panel 104 or integrally formed and connected with cover panel 104. In certain embodiments, locking tab 12 may be configured to extend from front fold flap 108 of cover panel 104, and in other embodiments, locking tab 12 may be configured to extend directly from cover panel 104, depending on the desired configuration and arrangement of the container 100 that includes tamper evident locking feature 10. Locking tab 12 may additionally be configured in a similar manner to the previously described embodiments.

As shown in FIG. 12A, locking tab 12 may include a terminal free edge 26 defining the perimeter boundary of locking tab 12 and extending from front fold flap 108 of top panel 104. As illustrated, terminal free edge 26 may form a semi-circular or curved shape that may facilitate the insertion of locking tab 12 into receiving slot 14 as described below; however, terminal free edge 26 may have any suitable shape or configuration in alternative embodiments of the present invention. As further shown in FIG. 12A, locking tab 12 may be configured similarly to locking end portion 18 of the previously described embodiments without the inclusion of an additional base portion 16; however, it is recognized that locking tab 12 may also be suitably configured with a base portion 16 and locking end portion 18 in certain embodiments of the present invention where locking tab 12 extends from cover panel 104.

As shown in FIG. 12A, locking tab 12 may include an intermediate locking slit 52 and corresponding intermediate locking edge 32 that may be intermediately located along a portion of the width of locking tab 12. Intermediate locking slit 52 and corresponding edge 32 may be configured as a cut, slit, incision or similar opening defined through the surface of locking tab 12. As shown in FIG. 12A, intermediate locking edge 32 may not extend across the entire width of locking tab 12 and may have a generally curved shape. As further shown in FIG. 12A, intermediate locking edge 32 may include transverse extension cut ends 34 located at each end of the curved portion of intermediate locking edge 32 and extending generally perpendicular to the curved portion of intermediate locking edge 32. As described in greater detail below, intermediate locking edge 32 (including extension cut ends 34) may function as a locking component of tamper evident feature 10 when locking tab 12 and receiving slot 14 are engaged.

As shown in FIG. 12A, locking tab 12 may further include fold or score end line 36 extending laterally away from each end of intermediate locking edge 32. Folding end edges 36 (along with intermediate locking slit 52 and corresponding edge 32) can enable the locking tab 12 to flex and pivot. As further shown in FIG. 12A, locking tab 12 may include perforated or scored tear-away lines 38 extending from transverse extension cut ends 34 (of intermediate locking edge 32) to terminal edge 26. As described in greater detail below, once locking tab 12 is engaged with receiving slot 14 to form tamper evident locking feature 10, scored tear-away lines 38 can assist in preventing locking tab 12 from being removed from receiving slot 14 without deformation of locking tab 12.

As also shown in FIG. 12A, locking tab 12 may further include an end section 40 that may be configured to be inserted into and received by receiving slot 14 (as described in greater detail below). As shown in FIG. 12A, end section 40 may include one or more ribbed extensions or fingers extending away from intermediate locking edge 32 to terminal edge 26. As best shown in FIG. 12A, the perimeter end section 40 may be defined by intermediate locking edge 32 and terminal edge 26 at each end and by transverse cut ends 34 and scored tear-away lines 38 along its sides. The ribbed extensions of end section 40 may be defined into tab 12 by means of scoring, perforation, indentation, surface marking or other means and can operate to stiffen and/or strengthen locking tab 12 to reduce bending or deformation of locking tab 12 once tamper evident feature 10 is engaged (as described below).

As shown in FIG. 12B, receiving slot 14 of tamper evident feature 10 may be defined into the sidewall panel 102 of the container 100 and may be configured in a similar manner to the previously described embodiments. As described in greater detail below, receiving slot 14 may be configured to fully or partially receive locking tab 12 when tamper evident feature 10 is engaged. As such, receiving slot 14 may be located at a position within sidewall panel 102 corresponding to the approximate length and position of locking tab 12 so that locking tab 12 may be inserted into receiving slot 14 to engage tamper evident feature 10. According to one embodiment, receiving slot 14 is positioned downward from the upper folded edge 112 of sidewall panel 102 at a distance approximately equal to the distance intermediate locking slit 52 and corresponding edge 32 located on locking tab 12 extend away from front fold flap 108 of top panel 104.

As best shown in FIG. 12B, receiving slot 14 may include a slit defined into and through the surface of sidewall panel 102 to form a corresponding receiving cut edge 42. As shown in FIG. 12B, receiving cut edge 42 may be intermediately positioned within sidewall panel 102 at a distance from the upper edge or upper folded edge 112 of sidewall panel 102 generally corresponding to the distance intermediate locking edge 32 of locking tab 12 is spaced from the folded edge 106 (connecting cover panel 104 and front fold flap 108) to enable end section 40 to be inserted within receiving slot 14. Receiving slit and corresponding receiving cut edge 42 may be configured as a cut, slit, incision or similar opening defined through the surface of sidewall panel 102.

According to the embodiment shown in FIG. 12B, receiving slit and corresponding edge 42 may have a curved shape with the curvature extending away from the upper folded edge 112 of sidewall panel 102. As described in greater detail below, the curvature of receiving slit and edge 42 may facilitate engagement of locking tab 12 with receiving slot 14. As further shown in FIG. 12B, the curvature of receiving cut edge 42 may generally correspond to and conform to the curvature of intermediate locking slit 52 and corresponding edge 32 (of locking tab 12) as shown in FIG. 12A. This corresponding curvature between edge 42 and edge 32 facilitates an overlapping and interlocked engagement when tamper evident feature 10 is enabled after locking tab 12 is inserted into receiving slot 14. It is further recognized that the receiving slit and cut edge 42 may have a linear, curved or other suitable shape and configuration in alternative embodiments of the present invention as long as the configuration enables locking tab 12 to be at least partially inserted through receiving slot 14.

As shown in FIG. 12B, receiving slot 14 may further include one or more minor cut lines 44 extending away from receiving cut edge 42. According to one embodiment, minor cut lines 44 (along with curved edge 42), may form one or more deflecting tabs or portions 46 along the convex side of curved edge 42. During engagement of tamper evident feature 10, deflecting tabs 46 may assist in maintaining the locked engagement of feature 10 and may deflect downward and engage with intermediate locking edge 32 to further prevent locking tab 12 from disengaging from receiving slot 14.

Figure 14:
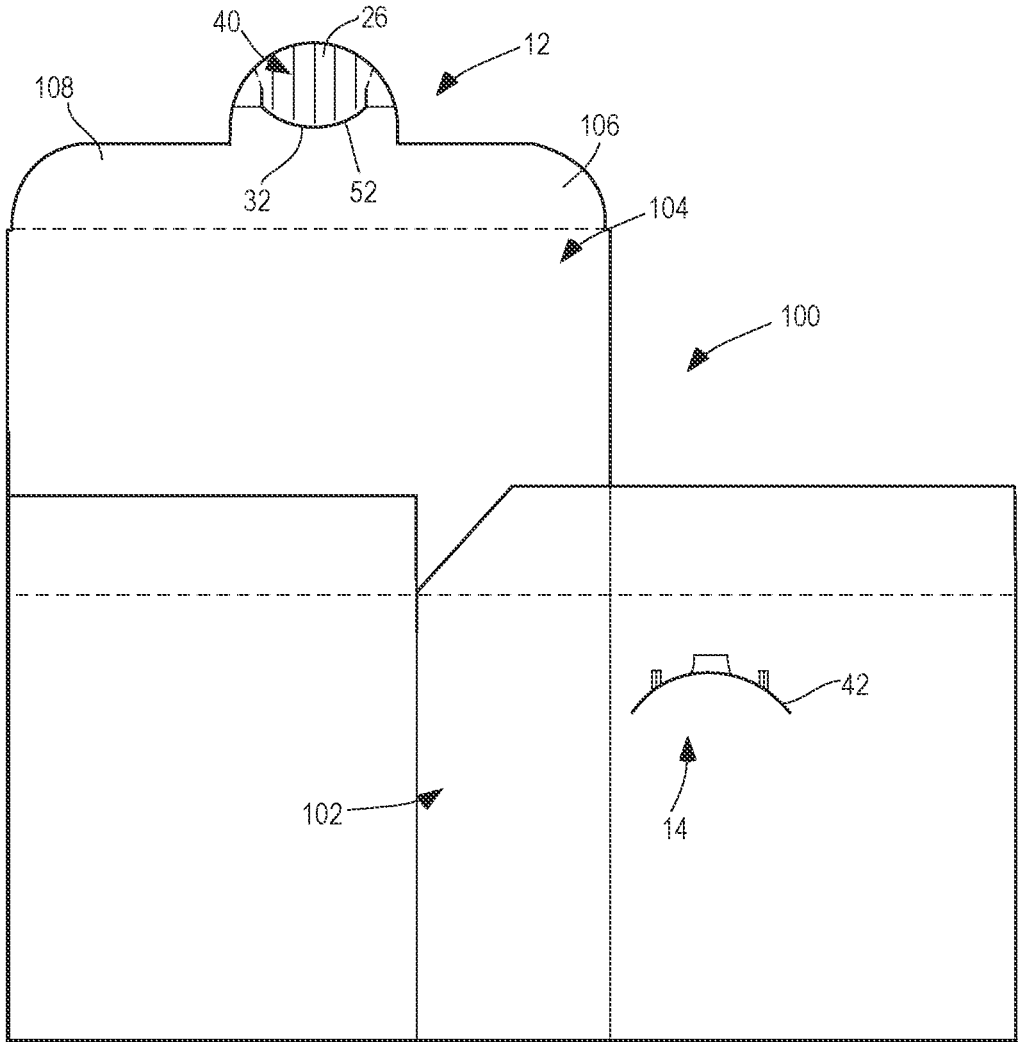
FIG. 14 is a plan view of a container with a tamper evident feature illustrating the container in a folded configuration in accordance with the second embodiment of the present invention.

As shown in FIGS. 13 and 14, tamper evident feature 10 may be incorporated into a container 100 formed from a foldable unitary blank 200. FIG. 13 illustrates blank 200 prior to being formed into container 100 according to one embodiment, while FIG. 14 illustrates container 100 formed from blank 200 and in a folded and flat configuration. As best shown in FIG. 13, container 100 may include one or more wall panels connected together at their ends, including a first or front sidewall panel 102. As further shown in FIG. 13, container 100 may include one or more cover flaps and a top or cover panel 104 connected to an upper edge of a wall panel and configured to enclose the upper portion of container 100 when formed from blank 200. As further shown in FIG. 13, container 100 may include one or more bottom panels forming a bottom end construction 110. Container 100 and blank 200 as illustrated in FIGS. 13 and 14 (as well as FIGS. 15-21) represent just one embodiment of the container 100 of the present invention and it is recognized that container 100 may have any suitable configuration utilized in enclosable carton and container structures.

As described above and also illustrated in FIGS. 13 and 14, container 100 includes tamper evident feature 10 incorporated therein. According to this embodiment, as illustrated in FIGS. 13 and 14, locking tab 12 of tamper evident feature 10 may be defined into and/or connected to front fold flap 108 of top panel 104 and extend outward therefrom, while receiving slot 14 of tamper evident feature 10 may be defined into first sidewall panel 102. Container 100 may further include additional features and/or configurations commonly found in carton and container constructions now known or hereinafter developed.

Figure 15:
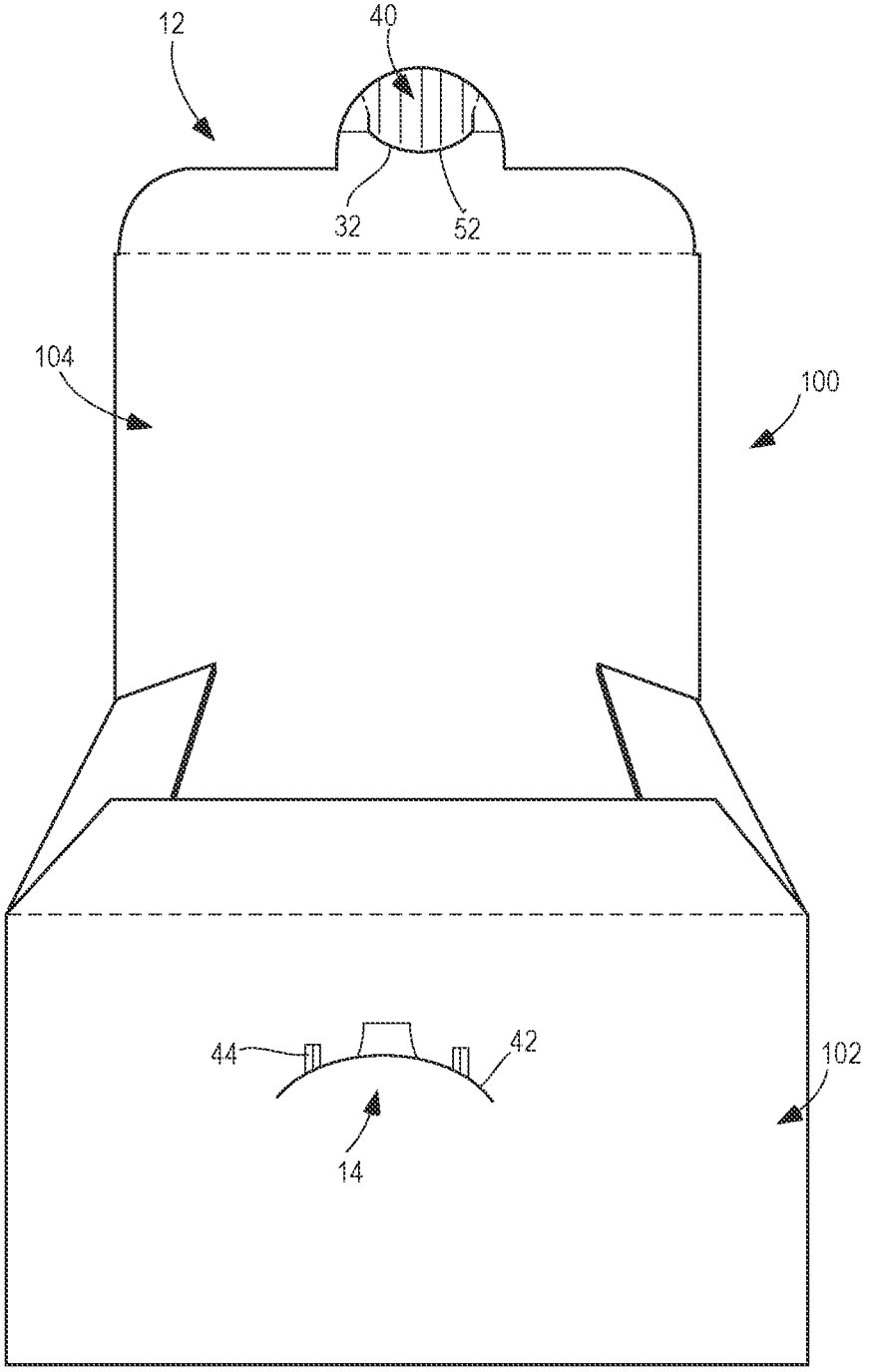
FIG. 15 is a perspective view of the container with tamper evident feature of FIG. 14 illustrating the container in an unfolded and opened configuration in accordance with the second embodiment of the present invention.

Turning to FIGS. 15-21, the use and configuration of tamper evident feature 10 and container 100 (with tamper evident feature 10 incorporated therein), according to the alternative embodiment, is illustrated in greater detail. As shown in FIG. 15, prior to engaging tamper evident feature 10, cover panel 104 of container 100 may be freely opened and closed to provide access to the interior of container 100. As shown, prior to engagement of tamper evident feature 10, locking tab 12 freely extends from top panel 104 and is disengaged from receiving slot 14.

Figure 16:
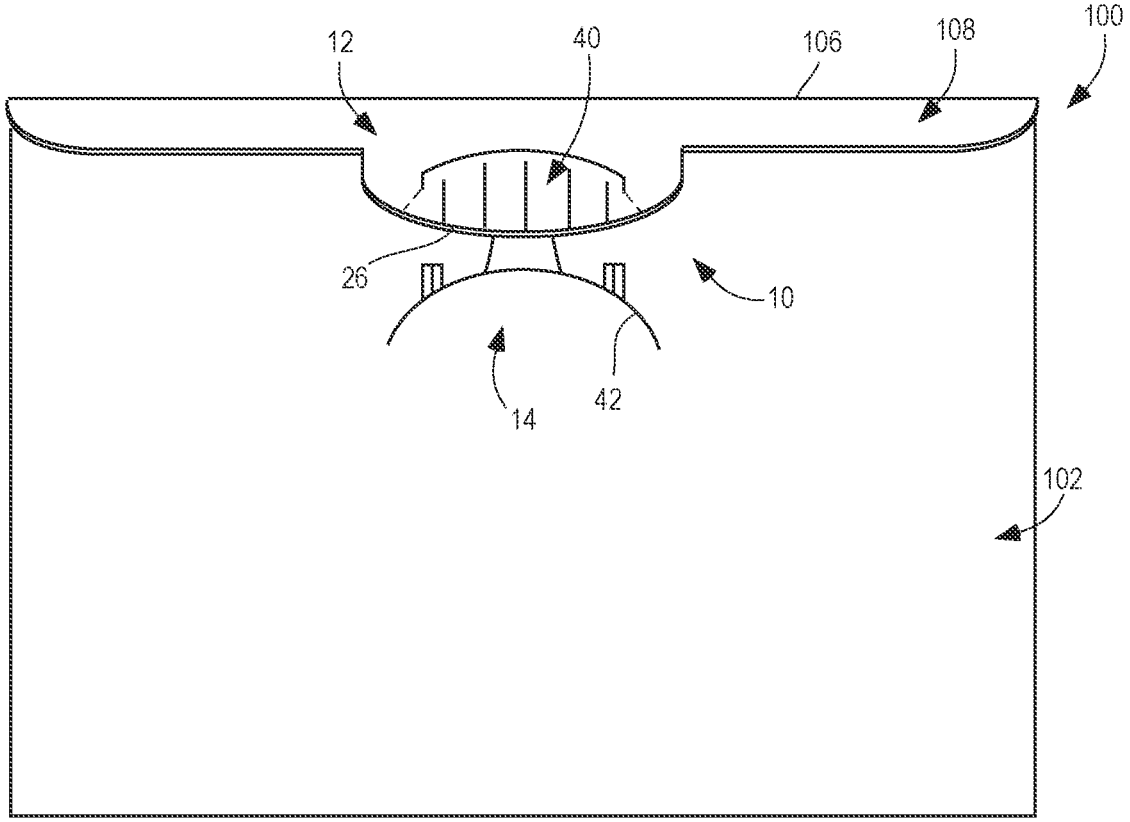
FIG. 16 is a perspective view of the container with tamper evident feature of FIG. 14 illustrating the container in a closed position in accordance with the second embodiment of the present invention.
Figure 17:
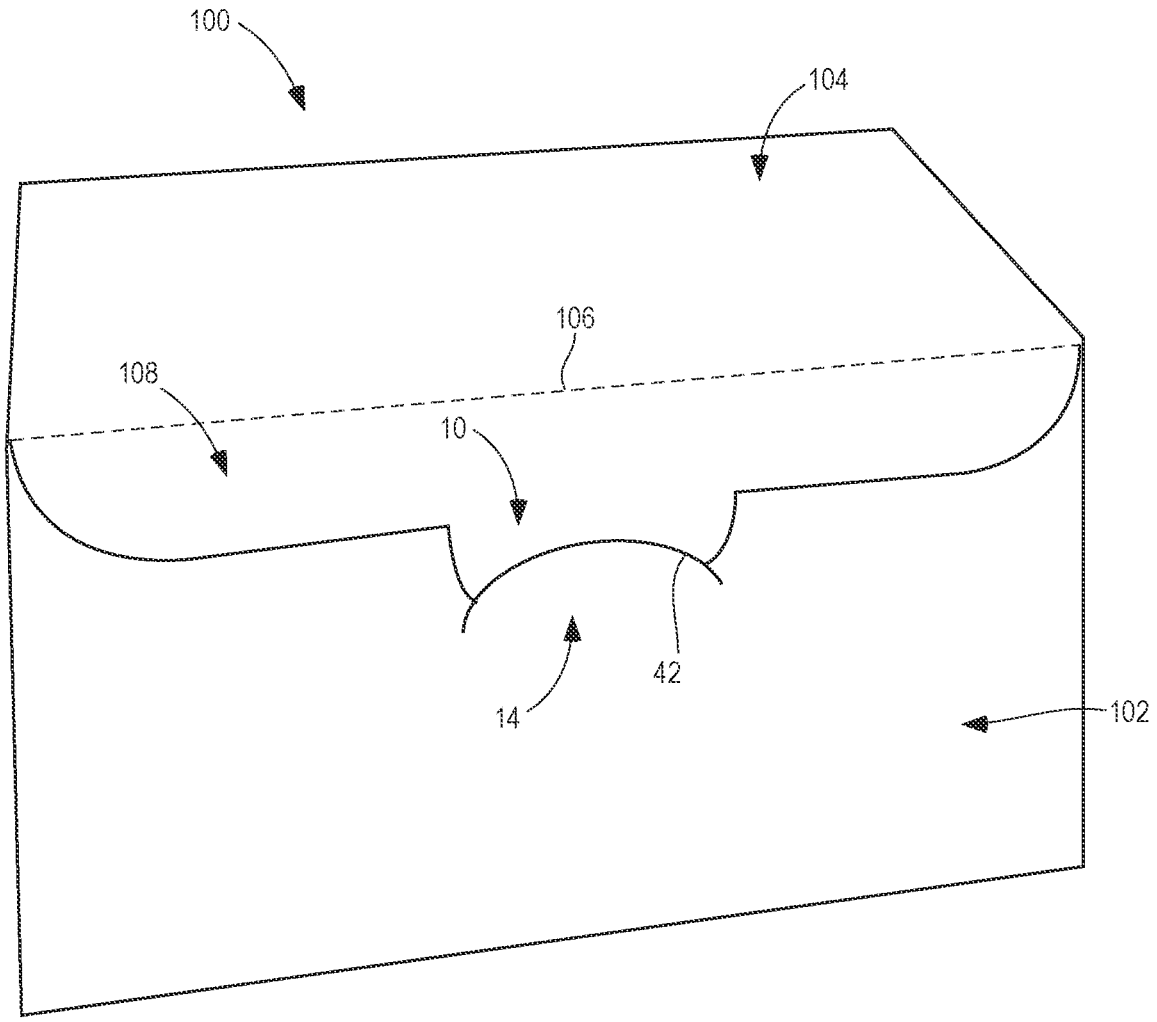
FIG. 17 is a perspective view of the container with tamper evident feature of FIG. 14 illustrating the container in a fully closed configuration with the tamper evident feature fully engaged in accordance with the second embodiment of the present invention.

As shown in FIG. 16, top panel 104 of the container 100 can be fully closed to enclose and seal in the contents located within the interior volume of container 100. FIG. 17 illustrates container 100 in a fully closed configuration where tamper evident feature 10 has been fully engaged and container 100 is restricted from opening without providing visible evidence of tampering. As shown, locking tab 12 has been folded over and the end section 40 of locking tab 12 has been inserted through receiving slot 14 so that intermediate locking edge 32 (of locking tab 12) and receiving cut edge 42 (of receiving slot 14) are interlocked together as described in detail below with reference to FIGS. 18-21).

Figure 18:
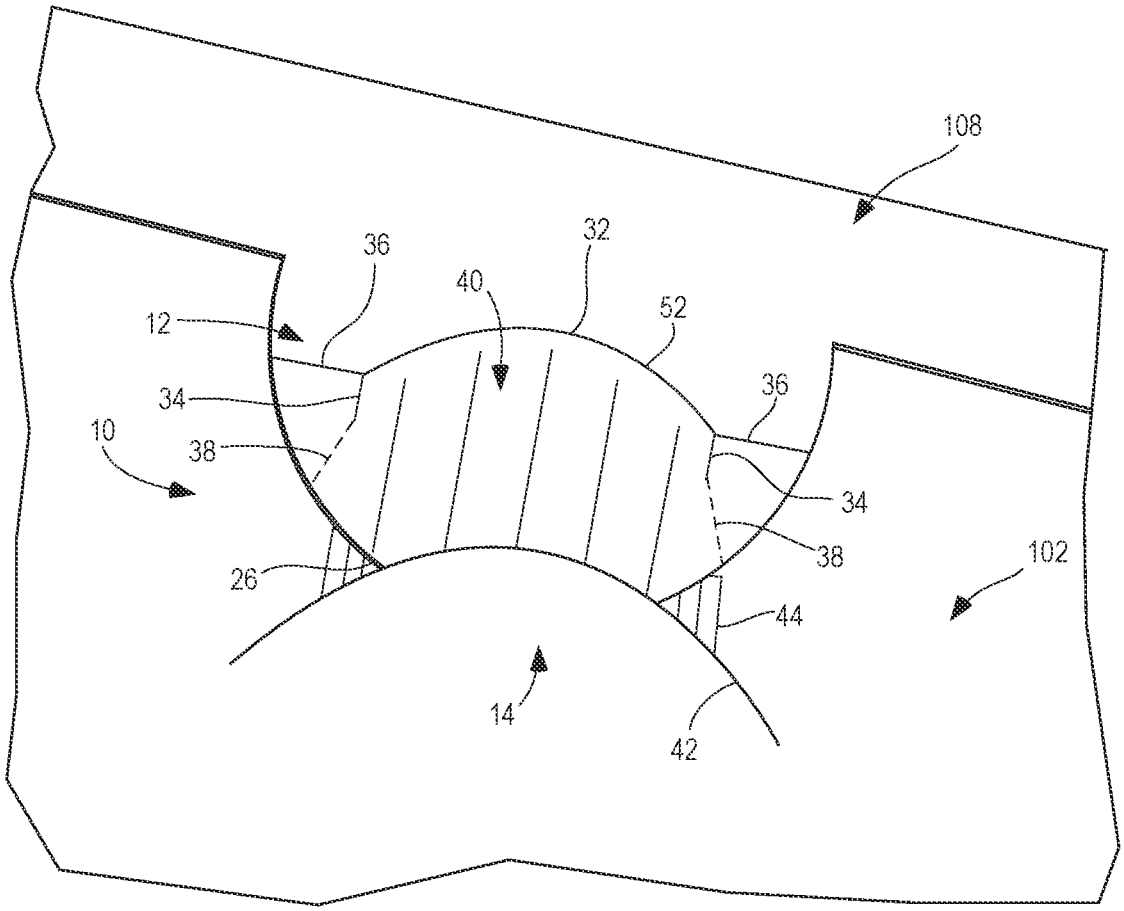
FIG. 18 is a partial perspective view of the container with tamper evident feature of FIG. 14 illustrating the initial engagement of the tamper evident feature in accordance with the second embodiment of the present invention.

As shown in FIG. 18, once cover panel is fully closed, locking tab 12 may be folded downward along front fold line 108 so that it generally overlies sidewall panel 102. As further shown in FIG. 18, locking tab 12 may be aligned with and inserted into receiving slot 14. When inserting locking tab 12 into receiving slot 14, the terminal edge 26 and ribbed end section 40 of locking tab 12 may be pushed through receiving slit and cut edge 42 (of receiving slot 14) defined into sidewall panel 102. As shown in FIG. 18, locking tab 12 may be partially bent or folded along fold end lines 36 (adjacent intermediate locking edge 32) to facilitate inserting end section 40 into receiving slot 14 by allowing locking tab 12 to have a slight downward angled orientation.

Figure 19:
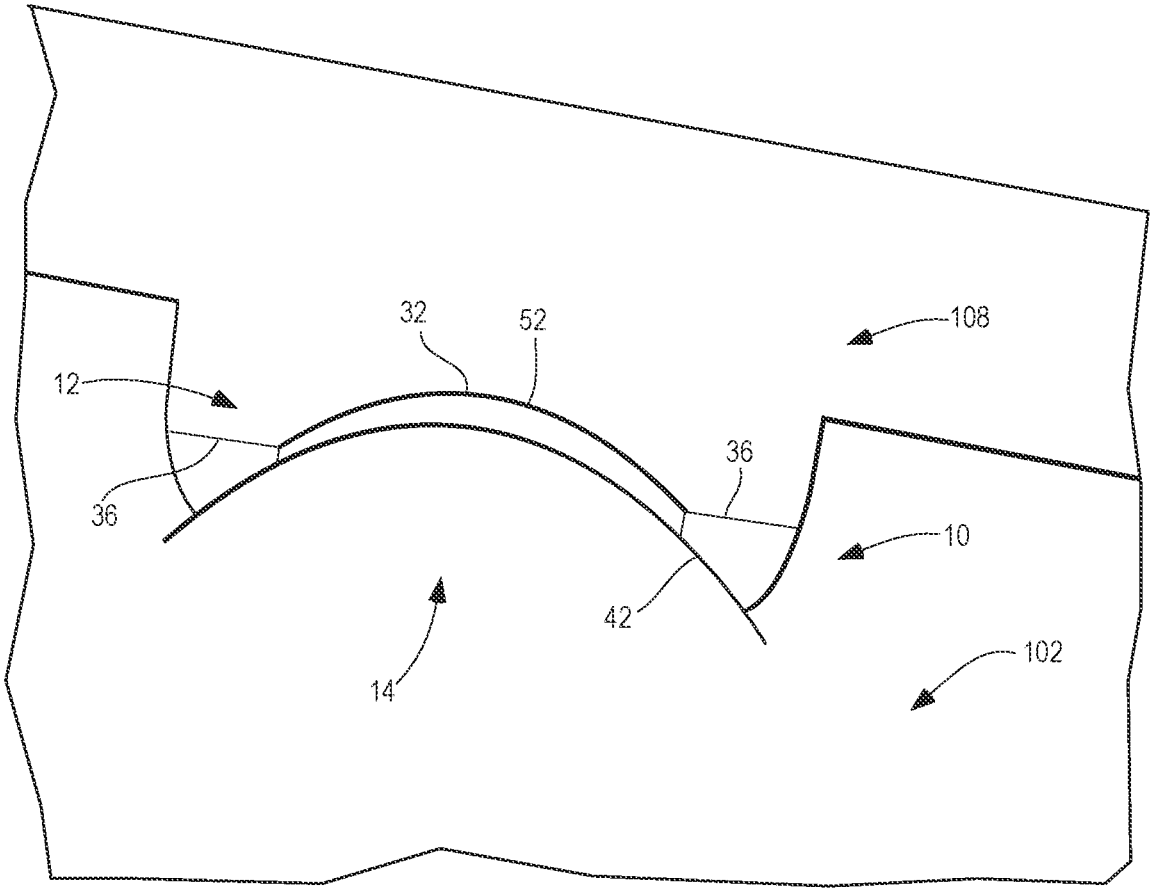
FIG. 19 is a partial perspective view of the container with tamper evident feature of FIG. 14 illustrating the partial engagement of the tamper evident feature in accordance with the second embodiment of the present invention.
Figure 20:
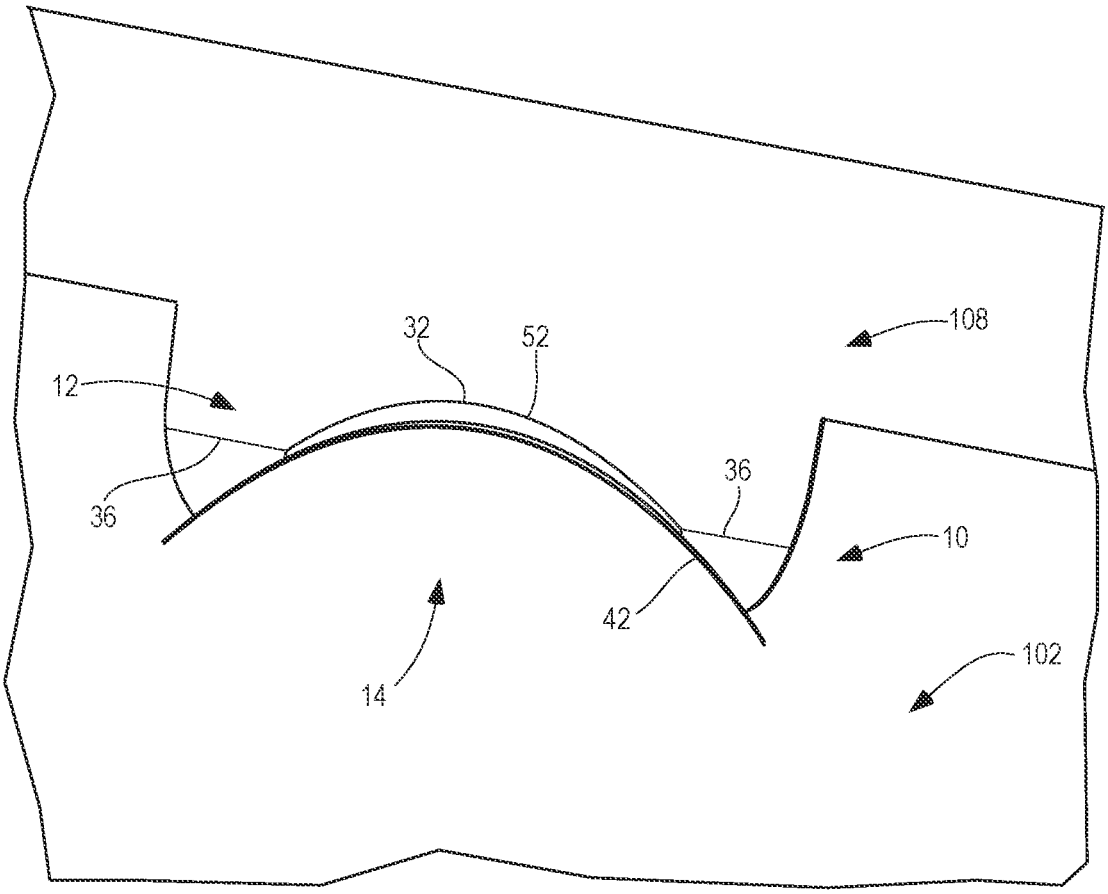
FIG. 20 is a partial perspective view of the container with tamper evident feature of FIG. 14 illustrating the full engagement of the tamper evident feature in accordance with the second embodiment of the present invention.
Figure 21:
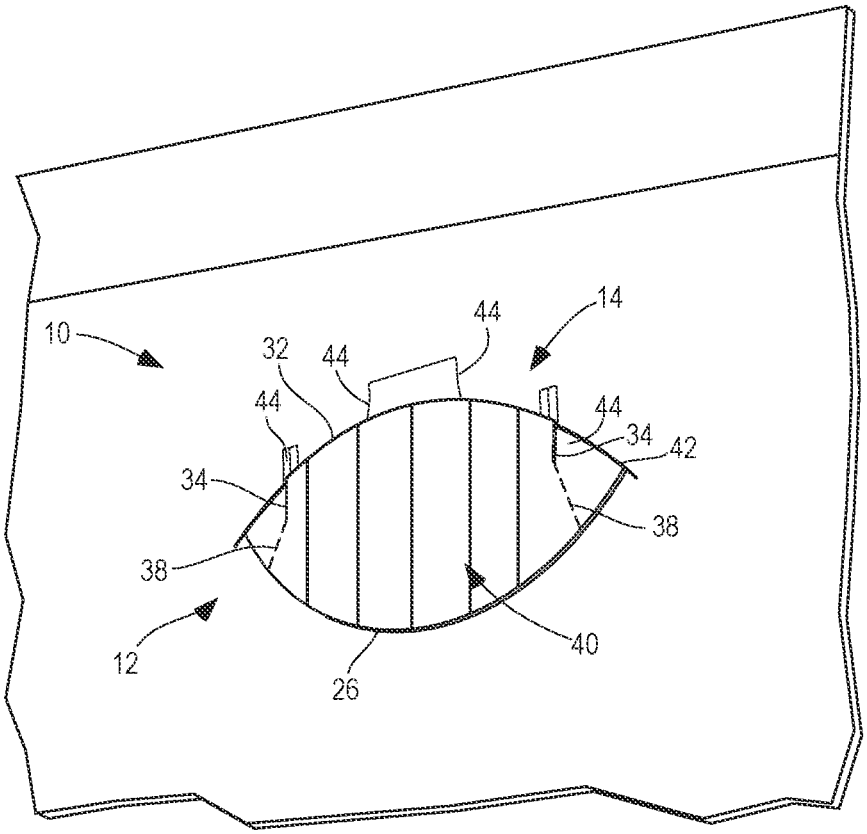
FIG. 21 is a partial perspective view of the interior of the container with tamper evident feature of FIG. 20 illustrating the full engagement of the tamper evident feature in accordance with the second embodiment of the present invention.

As shown in FIGS. 19-21, in order to fully engage tamper evident feature, locking tab 12 may be inserted into receiving slot 14 until terminal edge 26 and ribbed end section 40 is inserted past receiving cut edge 42 and fully through receiving slot 14. Once terminal edge 26 and ribbed end section 40 are fully inserted through slot 14, intermediate locking edge 32 on locking tab 12 may be positioned just beyond receiving cut edge 42 of receiving slot 14 (as best illustrated in FIGS. 20 and 21). According to one embodiment, as shown in the figures, receiving slot 14 may be positioned within sidewall panel 102 so that the distance from the apex of receiving cut edge 42 (of receiving slot 14) to upper folded edge 112 is approximately equal to and/or slightly less than the distance between the apex of curved intermediate locking edge 32 and folded edge 106 (connecting cover panel 104 and front fold flap 108). This configuration can enable tamper evident feature 10 to securely lock by allowing locking tab 12 to be inserted into receiving slot 14 so that intermediate locking edge 32 of locking tab 12 extends just beyond receiving cut edge 42 of receiving slot 14. As described above, intermediate locking edge 32 may also generally conform in shape and curvature to receiving cut edge 42 of receiving slot 14 so that when end section 40 of locking tab 12 is fully inserted within receiving slot 14, intermediate locking edge 32 and receiving cut edge 42 are substantially aligned and the entirety of intermediate locking edge 32 may be positioned just beyond receiving cut edge 42.

As best shown in FIG. 20, once locking tab 12 is partially inserted through receiving slot 14, the terminal edge 26 and ribbed end section 40 located along the outer portion of locking tab 12 are positioned underneath sidewall panel 102 of container 100 and no longer accessible from the exterior of container 100. When locking tab 12 is fully inserted through receiving slot 14, intermediate locking edge 32 on locking tab 12 may be positioned below and engage with the receiving cut edge 42 of receiving slot 14. The engagement may be enabled and facilitated by the configuration of transverse cut ends 34 extending from intermediate locking edge 32 on each end of intermediate locking edge 32, which allows intermediate cut edge 32 to deflect downward and slide past receiving cut edge 42 of receiving slot 14.

Similar to the previously described embodiments, according to the alternative embodiment, when locking tab 12 is first inserted to receiving slot 14, locking tab 12 may be positioned in a first engagement position where intermediate locking edge 32 is pushed forward just beyond receiving cut edge 42 of receiving slot 14. Locking tab 12 may then be pressed downward into a second engagement position where intermediate locking edge 32 is positioned slightly below or under receiving cut edge 42 of receiving slot 14. Finally, locking tab 12 may slightly retract from the forward position into a third engagement position where intermediate locking edge 32 (and the edge of end section 40) is located underneath and just prior to receiving cut edge 42 of receiving slot 14.

As described above, transverse cut ends 34 of intermediate locking edge 32 enable intermediate locking edge 32 (and the edge of end section 40) to move from the second engagement position to the third engagement position by providing a slot or opening at each end of the curved portion of intermediate locking edge 32 to partially receive receiving cut edge 42 of receiving slot 14. In accordance with this configuration, intermediate cut edge 32 slides slightly beyond receiving cut edge 42 when end section 40 of locking tab 12 is fully inserted into receiving slot 14, and then subsequently slides or retracts backward with intermediate locking edge 32 (and the edge of end section 40) being positioned underneath receiving cut edge 42 (and sidewall panel 102) as transverse cut ends 34 slightly receive receiving cut edge 42.

According to one embodiment, once locking tab 12 is fully inserted into receiving slot 14 and intermediate locking edge 32 of locking tab 12 is positioned just beyond receiving cut edge 42 of receiving slot 14, a downward pressure may be applied to receiving slot 14 (along the concave side of receiving cut edge 42) which can cause intermediate cut edge 32 of locking tab 12 to slide below and engage with receiving cut edge 42 to fully lock and engage tamper evident feature 10.

FIG. 21 illustrates an interior view from the interior of container 100 after locking tab 12 has been fully engaged with receiving slot 14. As described above, after partially inserting locking tab 12 through receiving slot 14, locking tab 12 can be continued to be pressed through slot 14 until intermediate locking edge 32 of locking tab 12 is approximately aligned with receiving cut edge 42 of receiving slot 14 on sidewall panel 102 (i.e., the first engagement position). Once aligned, a downward force or pressure can be applied to the curved receiving slot 14 which can cause intermediate cut edge 32 of locking tab 12 to move below (i.e., the second engagement position) and then engage with receiving cut edge 42 (i.e., the third engagement position). When transitioning from the second engagement position to the third engagement position, minor cut lines 44 on receiving slot 14 may also engage the transverse cut ends 34 extending toward terminal edge 26 of locking tab 12 as best illustrated in FIG. 21. This process of applying the downward force or pressure on curved receiving slot 14 may also result in an audible "clicking" sound that can notify a food operator that locking tab 12 and receiving slot 14 of the tamper evident feature 10 have been interlocked and engaged.

As shown in FIG. 21, when in the third engagement position and tamper evident feature 10 is fully engaged, intermediate locking edge 32 of locking tab 12 is positioned below receiving cut edge 42 and slightly or just beyond receiving cut edge 42 in the direction of the upper edge of sidewall panel 102 so that intermediate locking edge 32 and receiving cut edge 42 are slightly offset from one another. In this position, intermediate locking edge 32 and receiving cut edge 42 can become engaged and can restrict locking tab 12 from disengaging receiving slot 14.

Once the locking tab 12 is fully engaged with the receiving slot 14 (and intermediate locking edge 32 is engaged with receiving cut edge 42 of receiving slot 24), locking tab 12 may be restricted from disengaging with receiving slot 14 without tearing or deforming locking tab 12 and/or receiving slot 14. According to one embodiment, scored tear-away lines 38 extending from the transverse cut ends 34 of intermediate locking edge 32 to terminal edge 26 of locking tab 12 provide points or lines of weakness when locking tab 12 is attempted to be disengaged from receiving slot 14 after tamper evident feature 10 is enabled. In the event a user attempts to remove locking tab 12 from receiving slot 14, the intermediate locking edge 32 (including cut ends 34) become further interlocked with receiving cut edge 42 of receiving slot 14. This interlocking engagement between intermediate locking edge 32 and receiving cut edge 42 restricts locking tab 12 from exiting receiving slot 14 unless sufficient force is applied to scored tear-away lines 38 and ribbed end section 40 is separated from the remainder of locking tab 12. This has the effect of creating a tamper evident indicator if container 100 is opened after the tamper evident locking feature 10 has been engaged.

From the foregoing, it will be seen that this invention is one well adapted to attain all the ends and objects hereinabove set forth together with other advantages which are obvious, and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including", and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A tamper evident feature for a container having a wall panel and a cover panel, the tamper evident feature comprising:

a locking tab connected to the cover panel of the container, the locking tab comprising:

a terminal edge defining an outer edge of the locking tab;

an intermediate locking slit defined through the locking tab and extending at least partially across a width of the locking tab, the intermediate locking slit forming an intermediate locking edge within the locking tab, wherein the intermediate locking slit of the locking tab includes a transverse cut end located on each end of the intermediate locking slit, wherein each transverse cut end extends generally perpendicularly toward the terminal edge; and a tear-away line extending from each of the transverse cut ends to the terminal edge, wherein each tear-away line is configured as a line of weakness on the locking tab; and a receiving slot defined in the wall panel of the container, the receiving slot comprising:

a receiving slit defined into an intermediate portion of the wall panel, the receiving slit having a length equal to or greater than the width of the locking tab, and the receiving slit defining a receiving cut edge within the wall panel;

wherein the receiving slot is configured to receive the locking tab and the intermediate locking edge of the locking tab is configured to align with the receiving cut edge to engage the tamper evident feature.

2. The tamper evident feature of claim 1, wherein the intermediate locking edge of the locking tab is positioned below and slightly beyond the receiving cut edge of the receiving slot when the tamper evident feature is fully engaged.

3. The tamper evident feature of claim 1, wherein the tamper evident feature restricts the locking tab from being removed from the receiving slot without deformation of the locking tab or the container after the tamper evident feature has been fully engaged.

4. The tamper evident feature of claim 1, wherein the receiving slit and the receiving cut edge have a curved shape, and wherein the intermediate locking slit, and intermediate locking edge have a curvature generally corresponding to a curvature of the receiving slit and the receiving cut edge.

5. The tamper evident feature of claim 1, wherein the locking tab further comprises end fold lines extending laterally from each end of the intermediate locking slit to a perimeter side edge of the locking tab.

6. The tamper evident feature of claim 1, wherein the locking tab further comprises a ribbed extension portion extending between the intermediate locking edge and the terminal edge, wherein the ribbed extension portion comprises a plurality of ribs.

7. The tamper evident feature of claim 1, wherein the receiving slot further comprises at least one minor cut line extending from the receiving slit and toward an upper edge of a front wall panel.

8. A tamper evident container comprising:

a plurality of wall panels foldably connected together to form a sidewall, the plurality of wall panels including a front wall panel;

a cover panel foldably connected to one of the plurality of wall panels and movable between an open and closed position;

a bottom end construction connected to the plurality of wall panels; and a tamper evident feature comprising:

a locking tab connected to the cover panel extending beyond an outer edge of the cover panel, the locking tab including an intermediate locking slit defined through the locking tab and extending at least partially across a width of the locking tab, the intermediate locking slit forming an intermediate locking edge within the locking tab, wherein the intermediate locking slit of the locking tab includes a transverse cut end located on each end of the intermediate locking slit, wherein each transverse cut end extends generally perpendicularly toward a terminal edge of the locking tab, wherein the locking tab further comprises a tear-away line extending from each of the transverse cut ends to the terminal edge, wherein each tear-away line is configured as a line of weakness on the locking tab; and a receiving slot intermediately positioned within the front wall panel, the receiving slot including a receiving slit defined through the front wall panel and having a length greater than or equal to the width of the locking tab, the receiving slit forming a receiving cut edge within the front wall panel;

wherein the receiving slot is configured to receive the locking tab and the intermediate locking edge of the locking tab is configured to align with the receiving cut edge to engage the tamper evident feature;

wherein after the tamper evident feature is engaged, the tamper evident feature restricts the cover panel from moving from the closed position to the open position.

9. The tamper evident container of claim 8, wherein the intermediate locking edge of the locking tab is positioned below and slightly beyond the receiving cut edge of the receiving slot when the tamper evident feature is fully engaged.

10. The tamper evident container of claim 8, further comprising a front fold flap foldably connected to a front edge of the cover panel by a fold line, wherein the locking tab is connected to the front fold flap.

11. The tamper evident container of claim 8, wherein the receiving slit and the receiving cut edge have a curved shape, and wherein the intermediate locking slit, and intermediate locking edge have a curvature generally corresponding to a curvature of the receiving slit and the receiving cut edge.

12. The tamper evident container of claim 8, wherein the locking tab further comprises end fold lines extending laterally from each end of the intermediate locking slit to a perimeter side edge of the locking tab.

13. The tamper evident container of claim 8, wherein the locking tab further comprises a ribbed extension portion extending between the intermediate locking edge and a terminal edge of the locking tab, wherein the ribbed extension portion comprises a plurality of ribs.

14. The tamper evident container of claim 8, wherein the receiving slot further comprises at least one minor cut line extending from receiving slit toward an upper edge of the front wall panel.

15. A tamper evident feature for a container having a wall panel and a cover panel, the tamper evident feature comprising:

a locking tab connected to the cover panel of the container, the locking tab comprising:

a terminal edge defining an outer edge of the locking tab;

an intermediate locking slit defined through the locking tab and extending at least partially across a width of the locking tab, the intermediate locking slit forming an intermediate locking edge within the locking tab; and a ribbed extension portion extending between the intermediate locking edge and the terminal edge, wherein the ribbed extension portion comprises a plurality of ribs; and a receiving slot defined in the wall panel of the container, the receiving slot comprising:

a receiving slit defined into an intermediate portion of the wall panel, the receiving slit having a length equal to or greater than the width of the locking tab, and the receiving slit defining a receiving cut edge within the wall panel;

wherein the receiving slot is configured to receive the locking tab and the intermediate locking edge of the locking tab is configured to align with the receiving cut edge to engage the tamper evident feature.

16. A tamper evident container comprising:

a plurality of wall panels foldably connected together to form a sidewall, the plurality of wall panels including a front wall panel;

a cover panel foldably connected to one of the plurality of wall panels and movable between an open and closed position;

a bottom end construction connected to the plurality of wall panels; and a tamper evident feature comprising:

a locking tab connected to the cover panel extending beyond an outer edge of the cover panel, the locking tab including an intermediate locking slit defined through the locking tab and extending at least partially across a width of the locking tab, the intermediate locking slit forming an intermediate locking edge within the locking tab, wherein the locking tab further comprises a ribbed extension portion extending between the intermediate locking edge and a terminal edge of the locking tab, wherein the ribbed extension portion comprises a plurality of ribs; and a receiving slot intermediately positioned within the front wall panel, the receiving slot including a receiving slit defined through the front wall panel and having a length greater than or equal to the width of the locking tab, the receiving slit forming a receiving cut edge within the front wall panel;

wherein the receiving slot is configured to receive the locking tab and the intermediate locking edge of the locking tab is configured to align with the receiving cut edge to engage the tamper evident feature;

wherein after the tamper evident feature is engaged, the tamper evident feature restricts the cover panel from moving from the closed position to the open position.

* * * * *